US006022154A

United States Patent [19]

Allen

[11] Patent Number: 6,022,154

[45] **Date of Patent: *Feb. 8, 2000**

[54] IMAGE POSITION ERROR DETECTION TECHNIQUE USING PARALLEL LINES AND EMBEDDED SYMBOLS TO ALERT AN OPERATOR OF A MIS-REGISTRATION EVENT

[75] Inventor: Roy D. Allen, Burlington, Mass.

[73] Assignee: Agfa Corporation, Wilmington, Mass.

[ * ] Notice: This patent is subject to a terminal disclaimer.

[21] Appl. No.: 09/167,027

[22] Filed: Oct. 6, 1998

Related U.S. Application Data

[63] Continuation of application No. 08/789,812, Jan. 28, 1997, Pat. No. 5,857,784.

[51] Int. Cl.[7] ..... B41J 3/46

[52] U.S. Cl. ..... 400/76; 400/74; 101/181; 101/248

[58] Field of Search ..... 400/76, 74; 101/181, 101/248; 347/15

[56] References Cited

U.S. PATENT DOCUMENTS

| | | | |
|---|---|---|---|
| 4,273,045 | 6/1981 | Crowley | 101/211 |
| 4,532,596 | 7/1985 | Pugsley | 364/469 |
| 4,534,288 | 8/1985 | Brovman | 101/211 |
| 4,546,700 | 10/1985 | Kishner et al. | 101/211 |
| 4,679,071 | 7/1987 | Kitagawa | 358/75 |
| 4,913,049 | 4/1990 | Sainio | 101/211 |
| 5,056,430 | 10/1991 | Bayerlein et al. | 101/211 |
| 5,138,667 | 8/1992 | Roch et al. | 382/1 |
| 5,160,845 | 11/1992 | Stumbo et al. | 250/491.1 |
| 5,227,815 | 7/1993 | Dastin et al. | 346/160 |
| 5,237,394 | 8/1993 | Eaton | 356/402 |
| 5,434,604 | 7/1995 | Cleary et al. | 347/19 |
| 5,530,460 | 6/1996 | Wehl | 347/19 |
| 5,857,784 | 1/1999 | Allen | 400/74 |

OTHER PUBLICATIONS

"Highly sensitive register mark based on moire patterns", SPIE vol. 1912 Color Hard Copy and Graphic Arts II, pp. 423–427, Ralph Levien, Dec. 1993.

*Primary Examiner*—Ren Yan
*Assistant Examiner*—Charles H. Nolan, Jr.
*Attorney, Agent, or Firm*—Alfred A. Stadnicki

[57] ABSTRACT

A method for detecting image position errors, includes forming a first pattern with a symbol embedded therein and a second pattern which, when superpositioned on the first pattern, exposes the symbol if the misalignment between the first and second patterns exceeds a position error tolerance. The symbol is perceivable with the unaided eye even if the misalignment is imperceivable to the unaided eye.

22 Claims, 18 Drawing Sheets

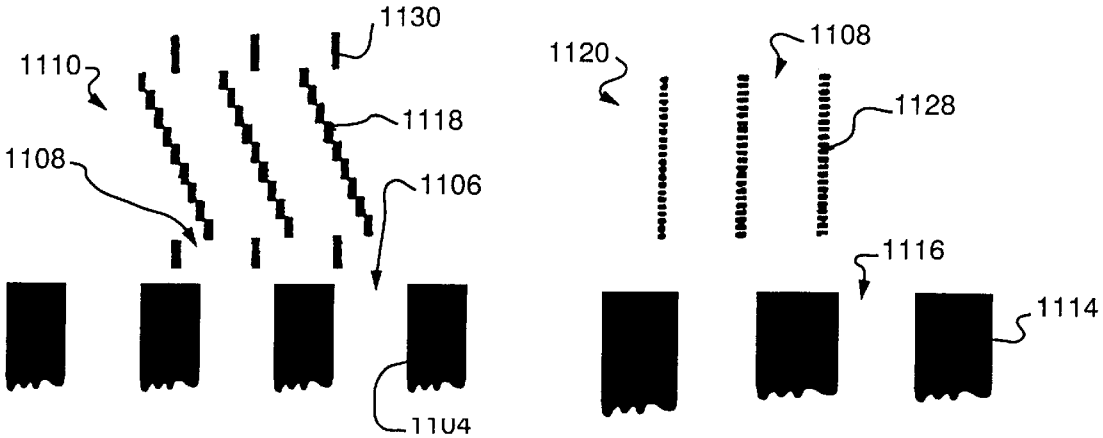
FIG. 11A
FIG. 11B
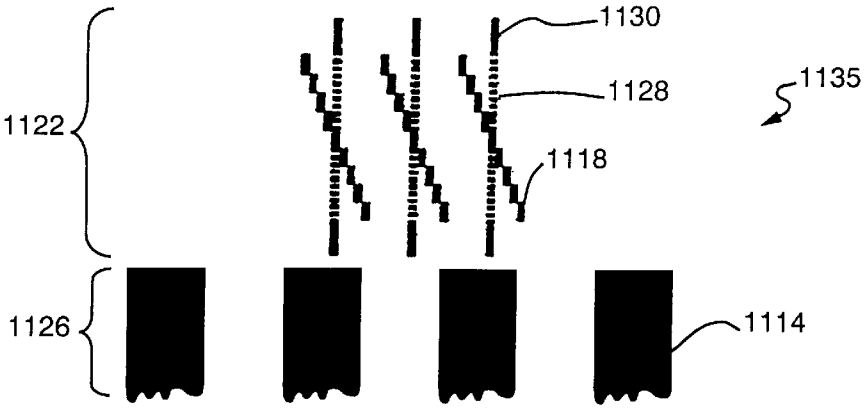
FIG. 11C

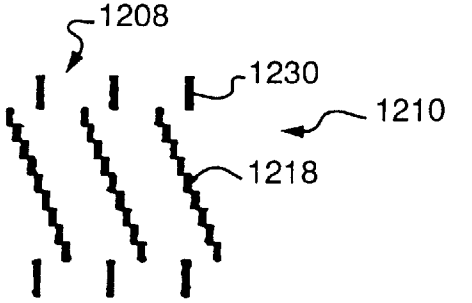
FIG. 12A
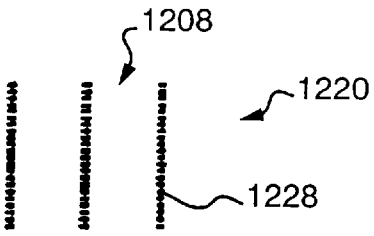
FIG. 12B
FIG. 12C
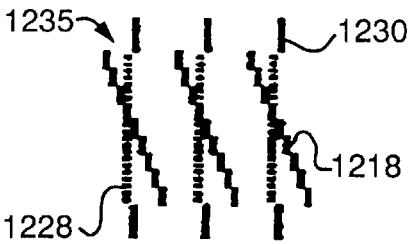
FIG. 12D
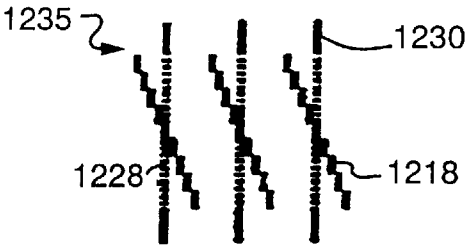
FIG. 12E
FIG. 12F
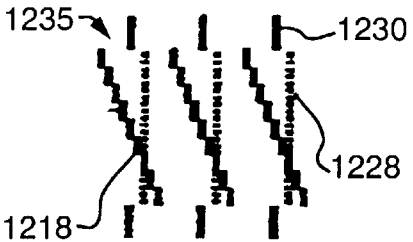
FIG. 12F
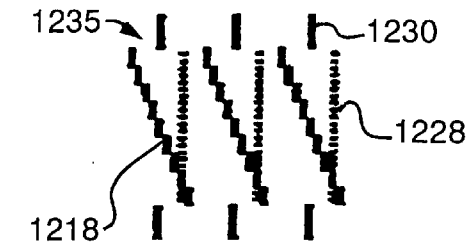
FIG. 12F

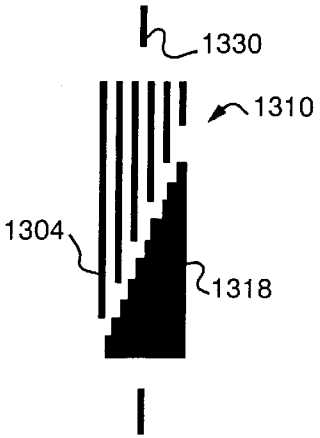
FIG. 13A
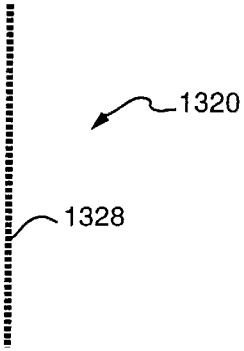
FIG. 13B
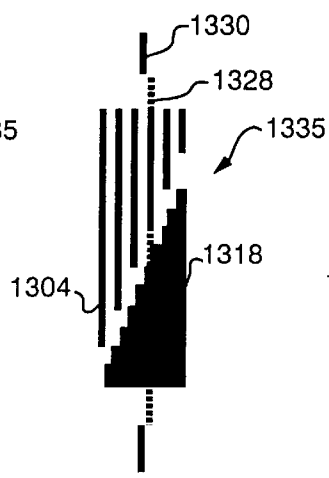
FIG. 13C
FIG. 13D
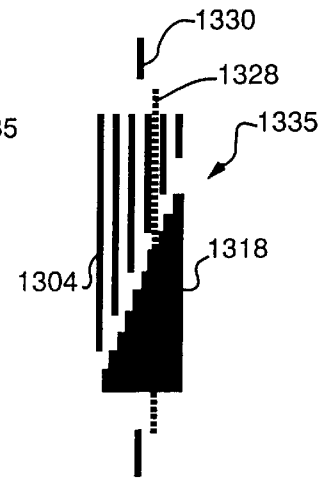
FIG. 13E
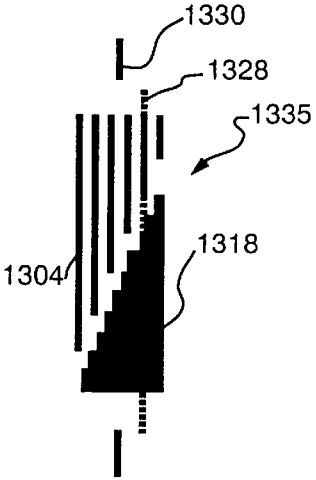
FIG. 13F

IMAGE POSITION ERROR DETECTION TECHNIQUE USING PARALLEL LINES AND EMBEDDED SYMBOLS TO ALERT AN OPERATOR OF A MIS-REGISTRATION EVENT

CONTINUITY DATA

This application is a continuation of Ser. No. 08/789,812, filed Jan. 28, 1997, now U.S. Pat. No. 5,857,784.

TECHNICAL FIELD

The present invention relates to position sensitive imaging and more particularly to a technique for providing enhanced detection of image position errors.

BACKGROUND ART

Modern electronic prepress, offset and other types of printing operations write or record images for subsequent reproduction or read a prerecorded image at a predefined resolution rate. Such systems may write or record images or in the case of prepress systems, read prerecorded images on various media including, photo or thermal sensitive paper or polymer films, photo or thermal sensitive coatings, erasable imaging materials or ink receptive media mounted onto an image recording surface, or photo or thermal sensitive paper, polymer film or aluminum base printing plate materials, all used in image reproduction. Such media are mounted onto a recording surface which may be planar or curved.

In the case of prepress systems, the primary components include a recording surface, usually a drum cylinder and a scan mechanism disposed and movable within the drum cylinder. The system also includes a processor, with an associated storage device, for controlling the scanning mechanism. The processor and associated storage device may be housed within the system itself or separate from the system with appropriate interconnection to the system. The processor, in accordance with stored programming instructions, controls the scanning mechanism to write or read images on the medium mounted to the inner drum cylinder wall by scanning one or more optical beams over the inside circumference of the drum cylinder while the drum cylinder itself remains fixed.

The scanning and hence the recording are performed over only a portion of the cylinder inner circumference, typically between 120° and 320° of the circumference of the drum cylinder. The optical beam(s) are typically emitted so as to be parallel with a central axis of the cylinder and are deflected, by for example, a spinning mirror, Hologon or Penta-prism deflector so as to form a single scan line or multiple scan lines which simultaneously impinge upon the recording surface. The deflector is spun or rotated by a motor about an axis of rotation substantially coincident with the central axis of the drum cylinder. To increase the recording speed, the speed of rotation of the beam deflecting device can be increased.

Notwithstanding the type of system, whether prepress, offset printing or otherwise, being utilized, it is of primary importance that the images be recorded as close as possible to a desired location to ensure that appropriately positioned images are formed on the recording surface and hence the desired image is properly recorded. For example, in prepress systems, a synchronization error or beam printing error in a scan engine, a media positioning error, or other types of anomalies will cause errors in the positioning of the image on the medium. In offset printing type systems, misalignment of the plates forming a multiple plate image or of the paper feed or other anomalies will similarly cause image position errors which manifest themselves as a positioning error between respective images.

Often in prepress or printing operations, it is required that the same image be recorded numerous times in a precise location on the same or different sheets of media. In such cases, it is imperative that the image be repeatable within a tight position tolerance, e.g. less than a mil, on each sheet. If an anomaly exists in scan mechanism or emitter of a prepress or the rollers or feed of an offset printer, the images will not be properly positioned on each of the sheets of media and the result will be unacceptable. Errors of this type are commonly characterized as registration errors.

In image setting operations, it is customary for the positional repeatability to be verified with the media held stationary, to within a specified tolerance in two axes by repetitively exposing a test page containing fiducial marks, e.g. cross hairs, with a line image in multiple exposure fashion to form a register or registration mark which simulates multiple separate full sheet exposures. At each cross hair location, the x-y position error over the multiple exposures is estimated using a magnifying lens, e.g. a microscope, to detect the deviation between the centers of the overlaid images.

Because the minimum line width, i.e., a single pixel, of the image setter is typically much larger than the repeatability errors which must be measured, resolution of the position error measurement even with a microscope is compromised using the conventional approach. Also, by exposing multiple single pixel lines on top of each other, blooming of the exposed lines will occur and significantly increase the thickness of the line so as to further compromise the measurement resolution. Blooming may be reduced by lowering the individual exposure levels of the single pixel lines; however, this tends to result in a loss of images for a first number of exposures because there is insufficient energy for the respective exposures to create a visible mark on the media when the exposure level is lowered enough to eliminate the blooming effects. It will be understood that the loss of the initial images is yet another form of measurement resolution loss.

Additionally, single pixel lines are susceptible to transient position errors caused, for example, by random wobble. Such transient position errors may be interpreted to mean that positional repeatability is unacceptable when, in fact, statistically the errors may not represent the overall repeatability within a given area, such as the area of a halftone dot. On the other hand, if the line width is increased to several pixels to increase visibility, and provide a better statistical representation of the overall repeatability, it becomes much more difficult to detect misalignments, which often exceed the position error tolerance by an amount much less than the width of the line. Further still, using the conventional technique, variables such as media response, spot size, exposure setting, media processing, etc., may significantly affect the ability to detect repeatability errors because these variables will have a greater impact on the results obtained using conventional techniques than the actual position error to be detected.

More sophisticated techniques for detecting repeatability errors have been proposed which overcome at least some of the difficulties in the conventional approach. For example, one proposal is to use a highly sensitive moire pattern formed by superpositioning two separate patterns having slightly different spatial frequencies to serve as the register mark. When the patterns are properly aligned, a bright spot appears in the center of the register mark. However, when the patterns are misaligned, the bright spot is visually displaced. Although improving a viewer's ability to visually perceive a misalignment between the patterns, small misalignment errors remain difficult if not impossible to detect with the unaided eye or even a microscope. Further, the technique does not provide a way to quantify the extent or degree, i.e., the magnitude of the misalignment error. Additionally, from a prepress standpoint, the technique inherently requires a relatively large number of cycles to provide the necessary effect. The technique is not intuitive but rather requires a trained eye to determine with any level of certainty that an unacceptable misalignment exists based upon the position of the bright spot within the register mark.

Another technique which has been proposed for use in ion beam lithography utilizes alignment marks and apertures. The light radiating from the alignment marks is sensed and the intensity of the detected radiating light is measured to determine if the apertures and alignment marks are misaligned. This technique, although providing a relatively accurate means of detecting a misalignment and of obtaining a positional null, is impractical when it comes to image generation/replication operations requiring visual verification of acceptable alignment or quantification of the extent of the misalignment without the use of complex and expensive sensing devices.

OBJECTIVES OF THE INVENTION

Accordingly it is an objective of the present invention to provide an accurate, high visibility indicator of micro-position errors which is perceivable with the unaided eye.

It is a further objective of the present invention to provide a self calibrating indicator of micro-position errors which is insensitive to process characteristics such as spot size, media gamma, and media processing.

It is a further objective of the present invention to provide a technique which allows microscopic calibration of misalignment error at the subpixel level to an absolute scale.

It is a further object of the present invention to provide a technique for magnifying misalignment errors imperceivable with the unaided eye so as to be perceivable with the unaided eye.

Additional objects, advantages, novel features of the present invention will become apparent to those skilled in the art from this disclosure, including the following detailed description, as well as by practice of the invention. While the invention is described below with reference to preferred embodiment(s), it should be understood that the invention is not limited thereto. Those of ordinary skill in the art having access to the teachings herein will recognize additional implementations, modifications, and embodiments, as well as other fields of use, which are within the scope of the invention as disclosed and claimed herein and with respect to which the invention could be of significant utility.

SUMMARY DISCLOSURE OF THE INVENTION

In accordance with the present invention, image position errors are detected by forming a first pattern with a predefined symbol embedded therein and a second pattern which is configured to be superpositioned, either physically, electronically or by optical projection, on the first pattern to thereby expose the embedded symbol if misalignment between the first and second patterns exceeds a position error tolerance. The exposing of the symbol magnifies the extent by which the misalignment exceeds the position error tolerance.

In image setting and offset printing operations, unacceptable misalignments may be at a subpixel level and not visible to the unaided eye. In accordance with the present invention, a subpixel level misalignment will cause the embedded symbol, which is visually perceivable with the unaided eye, to be exposed. As the misalignment increases, more and more of the embedded symbol is exposed in a linear relationship with the increase in the misalignment. Accordingly, the extent or degree by which the misalignment exceeds the position error tolerance is magnified by exposing the symbol. This increase in the visual impact of the misalignment allows an unskilled observer to immediately detect an unacceptable misalignment of the patterns and accordingly, provides a totally intuitive means of detecting whether or not positional error, including positional repeatability error, of an image is acceptable or unacceptable.

As will be recognized by those skilled in the art, the exposure of the embedded symbol serves to change the density of the superpositioned patterns to provide a visible indication of an unacceptable misalignment. Because a greater and greater portion of the embedded pattern is exposed or masked as the misalignment increases, the density of the superimposed patterns will vary depending upon the degree of misalignment between the patterns. The density can vary with the degree of misalignment in a linear or non-linear manner. Accordingly, the visual impact of the misalignment also changes, i.e., increases or decreases, with the increase and degree of misalignment.

In accordance with other aspects of the invention, the extent of a misalignment, even within the position error tolerance, can be accurately quantified and hence determined. For example, one technique for quantifying the misalignment is by forming the first pattern to have multiple parallel lines of a spatial frequency, i.e., having an equal pitch, and of an equal duty cycle, i.e., having an equal width. The second pattern is formed of multiple parallel lines of the same spatial frequency but having a duty cycle different than that of the lines of the first pattern. The duty cycle of the second pattern is selected so that the width of the lines of the second pattern exceeds the width of the lines of the first pattern by the position error tolerance. Advantageously, the pitch of the lines of the first and second patterns is equal to or greater than the sum of the widths of the lines of the first and second patterns.

The superpositioning of the second pattern over the first pattern results in the multiple lines of the second pattern being superimposed on the multiple lines of the first pattern. The lines of the first pattern are formed to extend beyond the end or edge of the lines of the second pattern. This allows the extent of misalignment between the first and second patterns to be accurately determined by comparing the position of the extended portion of the lines of the first pattern with the position of the lines of the second pattern in the area adjacent to the ends of the lines of the second pattern.

In accordance with additional aspects of the invention, the multiple parallel lines of the second pattern also have an extended portion, formed of contiguous or non-contiguous stepped or wedged segments, which are superimposed over an extended portion of the first pattern or vice versa. The stepped segments of the second pattern can be utilized to determine, i.e., quantify, the extent of misalignment between the patterns by comparing the relative positions of the extended portions of the two patterns in their superimposed disposition. If, for example, each stepped segment is in the shape of a square having sides one pixel in length, the extent of the misalignment can be easily and accurately determined to a pixel or a fraction thereof.

In accordance with further aspects of the invention, the multiple lines of the first and second patterns are disposed in one direction, e.g. vertical, and exposing the symbol embedded in the first pattern indicates a misalignment which exceeds the position error tolerance in a second direction which is orthogonal to the first direction, e.g. horizontal. To provide misalignment detection along two axes, a third pattern with a symbol embedded therein is formed of multiple parallel lines disposed at a pitch in the second direction. A fourth pattern is then formed of multiple parallel lines disposed in the second direction at the same pitch as the lines of the third pattern. The width of the lines of the fourth pattern exceeds the width of the lines of the third pattern by the applicable position error tolerance. By superimposing the fourth pattern on the third pattern, the symbol embedded in the third pattern is exposed if the misalignment between the third and fourth patterns exceeds the position error tolerance in the first direction, i.e., the direction of the lines of the first and the second patterns. Preferably, the first and third and the second and fourth patterns are identical but disposed orthogonally. If desired, the first and third and the second and fourth patterns could be respectively merged into a single pattern. Accordingly, superpositioning the first pattern over the second pattern would provide full two-axes misalignment error detection.

In accordance with still other aspects of the invention, the colors of each pattern may be different. Additionally, or alternatively, the color of the symbol may be different from that of other portions of the pattern in which it is embedded and/or of a superpositioned pattern. The symbol may be an alphabet, numeric or other character. The symbol could include characters such as arrowheads indicating the direction of the misalignment or such other predefined symbol as may be desired to provide a clear indication to an observer of the characteristics of the misalignment error.

To implement the above described technique, a scanner or printing press is driven by a controller to form a pattern which, when superimposed on another pattern which includes an embedded symbol, will expose the symbol if misalignment between the patterns exceeds the applicable position error tolerance, if any. The scanner or press is driven by the controller to form the pattern as previously described. The latter pattern may be preprinted or formed by the same or a different scanner or press.

The patterns may be formed on different media which are then overlaid and aligned to superposition one pattern over the other. One pattern may be preprinted on a medium and the other pattern formed on the medium prior to or during actual production printing operations. One pattern may be simultaneously formed and superimposed on the other pattern if desired, or may be formed on the same medium in a separate location from the other pattern. In this latter case, the medium can be subsequently manipulated, e.g., folded over, to superimpose one pattern over the other or both patterns may be read using one or more sensor assemblies to create representative signals. Signals output from the sensors are then processed to determine if the superpositioning of one pattern on the other would expose the embedded symbol. If one of the patterns is formed so as to be superpositioned over the other pattern, a single sensor assembly can be used to read the superpositioned patterns, i.e., the registration mark or pattern thereby created, and to generate a signal representative thereof. The signal representing the superpositioned patterns can then be processed to determine if and to what extent the embedded symbol is exposed. In either case, the sensor(s) may form part of a closed loop system with the processor outputting a signal which is used to direct the automatic or manual adjustment or servicing of the system to correct any detected misalignment error.

Although specific patterns are described herein, it should be understood that the described patterns are intended only as examples and that a primary feature of the present invention is the provision of a visible density change in the registration mark to indicate an unacceptable misalignment between the patterns and/or provide a visible and proportionate measure of the relative position error between the patterns. As discussed above, this can be accomplished by embedding a symbol in one of the patterns, although this is not mandatory, and those skilled in the art will understand that patterns without an embedded symbol could be utilized to obtain the necessary density variation in accordance with the invention.

BRIEF DESCRIPTION OF THE DRAWINGS

FIG. 11A depicts a first pattern having stepped segments for use in forming a registration mark in accordance with the present invention.

FIG. 11B depicts a second pattern for use with the pattern of FIG. 11A in forming a registration mark in accordance with the present invention.

FIG. 11C depicts a registration mark formed with the patterns of FIGS. 11A and 11B indicative of 0° phase error.

FIG. 12A depicts still another first pattern for use in forming a registration mark in accordance with the present invention.

FIG. 12B depicts a second pattern for use with the pattern of FIG. 12A in forming a registration mark in accordance with the present invention.

FIG. 12C depicts a registration mark formed with the patterns of FIGS. 12A and 12B having a minus two pixel error.

FIG. 12D is similar to FIG. 12C but indicative of a minus one pixel error.

FIG. 12E is similar to FIG. 12C but indicative of a zero pixel error.

FIG. 12F is similar to FIG. 12C but indicative of a one pixel error.

FIG. 12G is similar to FIG. 12C but indicative of a two pixel error.

FIG. 12H is also similar to FIG. 12C but indicative of a three pixel error.

FIG. 13A depicts another pattern which can be substituted for that depicted in FIG. 12A in forming a registration mark in accordance with the present invention.

FIG. 13B depicts a second pattern similar to that depicted in FIG. 12B for use in forming a registration mark in accordance with the present invention.

FIG. 13C depicts a registration mark formed with the patterns of FIGS. 13A and 13B having zero phase error.

FIG. 13D is similar to FIG. 13B but indicative of a one pixel error.

FIG. 13E is similar to FIG. 13C but indicative of a two pixel error.

FIG. 13F is similar to FIG. 13C but indicative of a two and one-half pixel error.

DETAILED DESCRIPTION OF PREFERRED EMBODIMENTS

Figure 1A:
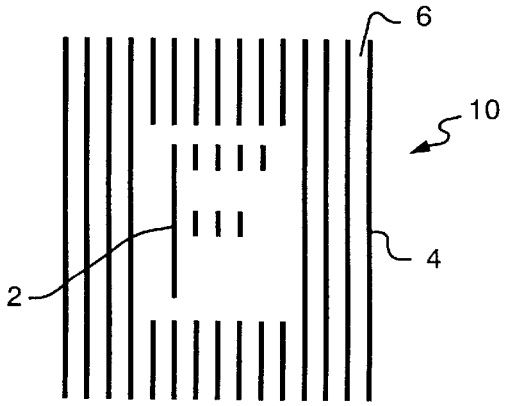
FIG. 1A depicts a first pattern for use in forming a registration mark in accordance with the present invention.

FIG. 1A depicts a first pattern 10 which is used to form a registration mark in accordance with the present invention. As depicted, the pattern 10 has the symbol "F" embedded therein and identified with reference numeral 2. The pattern 10 is formed of multiple parallel lines 4 having a spatial frequency and a duty cycle. FIG. 1A depicts a 13× magnification of the actual pattern generated at 3600 dpi addressability. The multiple parallel vertical lines 4 are four pixels in width and have a twelve pixel pitch which is equivalent to 3.3 mils at 3600 dpi. The unwritten areas 6 between the lines 4 of the pattern 10 have a width of eight pixels.

Figure 1B:
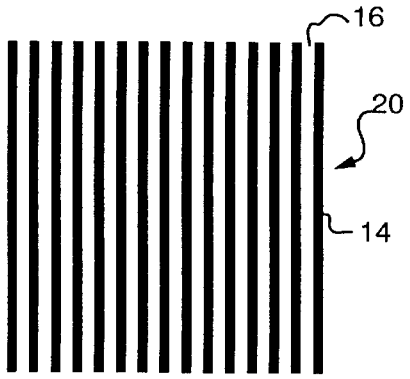
FIG. 1B depicts a second pattern for use in forming a registration mark in accordance with the present invention.

FIG. 1B depicts a second pattern 20 which will also be used to form the registration mark. The pattern 20 has an identical spatial frequency but a different duty cycle than pattern 10 of FIG. 1A. Pattern 20 is formed of multiple parallel lines 14. As depicted, the multiple lines 14 of the pattern 20 have a six pixel width and twelve pixel pitch. The unwritten spaces 16 each also have a width of six pixels.

It will be understood that the spatial frequency and duty cycles of the patterns 10 and 20 are exemplary. However, preferably the spatial frequency of patterns 10 and 20 will be equal to each other. The width of the lines 4 of pattern 10 could be reduced to a single pixel width or increased as may be desirable for the particular implementation. The spaces 6 between the lines will typically be increased or decreased depending on the width of the lines 4. Similarly, the thickness of the lines 14 of the pattern 20 will generally be increased or decreased depending both upon the thickness of the lines 4 of pattern 10 and the misalignment error tolerance, if any. The unwritten spaces 16 of pattern 20 will likewise be increased or decreased with the increase or decrease in the width of the lines 14.

If zero error tolerance is required, the width of lines 14 of pattern 20 is beneficially made equal to the width of lines 4 of pattern 10; however, if some degree of misalignment can be tolerated, the width of the lines 14 will preferably exceed the width of the lines 4 by twice the position error tolerance. In the present case, the position error tolerance, as will be discussed further below, is one pixel in either horizontal direction. Accordingly, the width of the lines 14 of pattern 20 exceeds that of lines 4 of pattern 10 by two pixels.

Figure 1C:
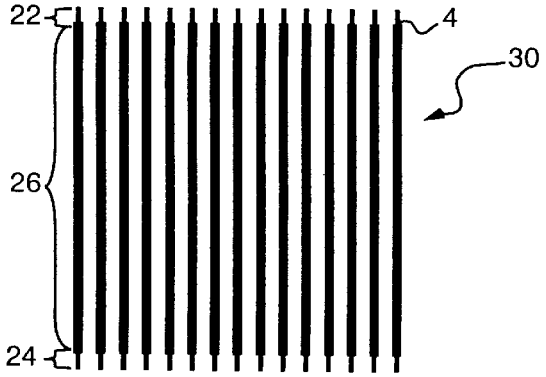
FIG. 1C depicts a registration mark indicative of 0° phase error.

FIG. 1C depicts the pattern 20 superpositioned over the pattern 10 to form a registration mark or pattern 30 with zero phase error, i.e., the patterns 10 and 20 are perfectly aligned. As can be seen in FIG. 1C, the pattern 10 has portions 22 and 24 consisting of the segments of lines 4 which extend beyond respective ends or edges of the lines 14 of pattern 20. The other portion 26 of pattern 10 has the symbol 2 embedded therein. The extended portions 22 and 24 of the registration pattern 30 can be used to quantify the misalignment to an accuracy of a fraction of a pixel, even if the misalignment of the patterns 10 and 20 is within an acceptable position error tolerance.

It will be noted that with the patterns 10 and 20 in alignment, as shown in FIG. 1C, the embedded symbol 2 is hidden by the lines 14 of pattern 20. It should further be noted that so long as any misalignment between patterns 10 and 20 is less than one pixel in either direction, and hence within the acceptable position error tolerance, the embedded symbol 2 of pattern 10 will remain masked by the lines 14 of pattern 20 and thus will not be visible. Accordingly, an observer viewing the registration mark 30 can quickly and easily determine with the unaided eye, i.e., without the use of a magnifying lens, that the alignment of the patterns 10 and 20 is within tolerance and the repeatability of images is acceptable.

Figure 1D:
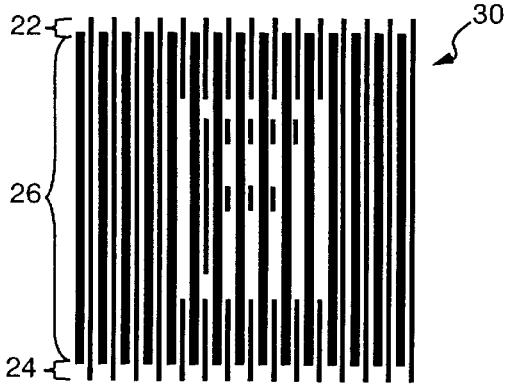
FIG. 1D depicts a registration mark indicative of 180° phase error.

FIG. 1D depicts the registration mark 30 with the patterns 10 and 20 180° out of phase. As indicated in FIG. 1D, the embedded symbol 2 of pattern 10, i.e., the character "F", is fully unmasked by the misalignment. The character "F" is exposed with a high density border around it. This provides a dramatic visual indication to the unaided eye that the position error threshold or tolerance has been exceeded. The density of the embedded symbol 2 and the border around it will, in this example, vary linearly with the magnitude of the misalignment error at a rate of approximately 30% dot per mil error. However, if desired, the patterns could be selected to provide a non-linear density variation.

As discussed above, the embedded symbol 2 remains masked by the pattern 20 until the misalignment between symbols 10 and 20 exceeds the one pixel the position error tolerance, i.e., 0.27 mil in the present example, in either horizontal direction. In the present example, the duty cycles were chosen specifically to maximize the visual contrast between a 0 and 180° phase error in the alignment of symbols 10 and 20. However, the duty cycles of the respective patterns could be chosen to maximize the visual contrast at different phase error states, if so desired. In any event, it is of primary importance that the symbol 2 become visible upon the misalignment exceeding the acceptable position error tolerance, i.e., upon the positional error minimally exceeding the position error tolerance.

The unmasking of both the embedded symbol 2 and those lines 4 in portion 26 of the pattern 10 which do not form part of symbol 2, change the density of the registration mark 30 when the misalignment between the patterns 10 and 20 exceeds the misalignment threshold or tolerance. If desired, pattern 10 could be formed only by the symbol 2 or without an embedded symbol. In either case, a visible density change will occur with the patterns 180° out of phase. However, the use of the embedded symbol enhances the visual effect and the intuitive nature of the registration mark 30 such that an observer can confidently determine with the unaided eye if patterns 10 and 20 are misaligned beyond the acceptable tolerance. It will, of course, be recognized by those skilled in the art that although, in this example, a maximum density change occurs at 180° phase error, a visible density change will occur over approximately a ±300° phase range. That is, the symbol will remain exposed to some extent over this range.

Figure 2A:
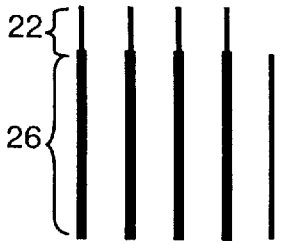
FIG. 2A depicts portions of the registration mark shown in FIG. 1C.

FIGS. 2A–F depict an expanded view of the portion 22 extending beyond the edge of the portion 26 of the registration mark 30. In the case of FIG. 2A, the registration mark 30 is as shown in FIG. 1C, i.e., the patterns 10 and 20 have a 0° phase error and are therefore perfectly aligned. As noted above, the extended portion 22 of registration mark 30 allows an observer to more accurately determine, i.e., quantify, the extent of any misalignment in the patterns 10 and 20 even when the misalignment is within the applicable position error tolerance. The extended portion 22 is also useful in confirming if the patterns are perfectly aligned. With the patterns 10 and 20 in perfect alignment as shown in FIG. 1C, or misaligned but within tolerance, the registration mark 30 has approximately a 50% dot or tint.

Figure 2B:
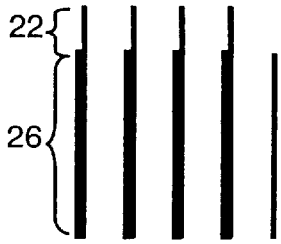
FIG. 2B depicts portions of a registration mark similar to that depicted in FIG. 1C but with a phase error within an acceptable error tolerance.

FIG. 2B depicts the portions 22 and 26 of registration mark 30 with the patterns 10 and 20 misaligned by one pixel and hence within the position error tolerance for the present example. The density of the registration mark 30 at a one pixel phase error has not increased. The extending portion 22 of pattern 30 allows the observer to easily and more precisely determine the degree of the alignment error even with the misalignment being within the allowable tolerance. Because the patterns 10 and 20, and hence the registration mark 30, will advantageously be formed in a very small area on the media, e.g. less than 0.25 square inches, and often the alignment errors will be at a subpixel, it will typically be necessary to utilize a magnifying lens, such as a microscope, to view the relationship of portion 22 adjacent to portion 26 of pattern 30, even though the symbol 2, to the extent exposed, will be visible with the unaided eye. Accordingly, an observer can immediately detect with the unaided eye whether or not the image repeatability is within or outside of tolerance but may need to use a magnification device to quantify the extent or degree of the misalignment from the portion 22 extending from portion 26 of the registration pattern 30.

Figure 2C:
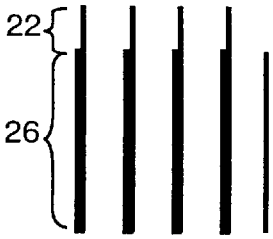
FIG. 2C depicts a portion of a registration mark similar to that depicted in FIG. 1C but with a phase error exceeding an acceptable error tolerance by one pixel.

FIG. 2C depicts portions 22 and 26 of registration mark 30 with a two pixel misalignment, i.e., a misalignment of 0.55 mil in the present example. The pattern 30 will have an approximately 58% dot or tint at a two pixel alignment error. Although not depicted, the embedded symbol 2 will be partially exposed and perceivable with the unaided eye such that an observer can immediately determine that an unacceptable repeatability error exists. Once again, by viewing the relative positions of portion 22 and portion 26 of the registration mark 30, the observer is able to more accurately detect the degree or extent by which the repeatability error tolerance is exceeded and in which horizontal direction.

Figure 2D:
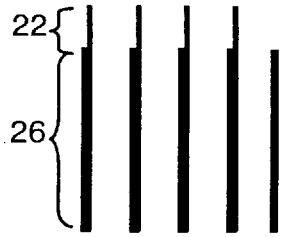
FIG. 2D depicts a portion of a registration mark similar to that depicted in FIG. 1C but with a phase error exceeding an acceptable error tolerance by two pixels.

FIG. 2D is similar to FIG. 2C except that the misalignment error is now at three pixels, i.e., 0.83 mils in the present example. The registration mark 30 further exposes the embedded symbol 2 and now has a 66% dot or tint.

Figure 2E:
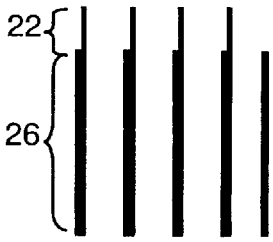
FIG. 2E depicts a portion of a registration mark similar to that depicted in FIG. 1C but with a phase error exceeding an acceptable error tolerance by three pixels.

FIG. 2E depicts a further misalignment of the patterns 10 and 20. As depicted, the patterns 10 and 20 are misaligned by four pixels, i.e., 1.11 mil in the present example. The registration mark 30 will have approximately a 72% dot or tint when a four pixel misalignment exists. The embedded symbol 2 will be still further exposed and hence, the density of the registration mark 30 will further increase.

Figure 2F:
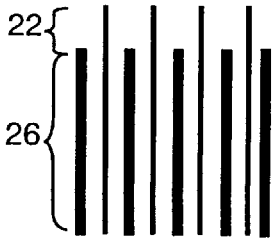
FIG. 2F depicts a portion of the registration mark shown in FIG. 1D.

Turning now to FIG. 2F, a 180° phase error between patterns 10 and 20 is depicted, as also shown in FIG. 1D. As indicated, the lines 4 of pattern 10 are no longer contiguous with the lines 14 of pattern 20 in the registration mark 30 but rather are separated therefrom by narrow unwritten spaces. The registration mark 30 now is at approximately 90% dot or tint and at its maximum density.

As indicated in FIGS. 2A–2F, as the degree of misalignment increases beyond the acceptable threshold, the density of the registration pattern 30 linearly increases with the increase in the misalignment error. It will be understood that although in the present example, the patterns 10 and 20 are orientated to detect a horizontal misalignment error, by simply rotating the patterns 90°, vertical misalignment errors can be detected.

Furthermore, different pattern configurations could be utilized to detect two axes misalignments from a single pair of superpositioned patterns. FIGS. 14A–F are directed to the formation of a single registration mark having a single embedded symbol which allows visual detection with the unaided eye of unacceptable misalignments in either of two orthogonal directions.

Figure 14B:
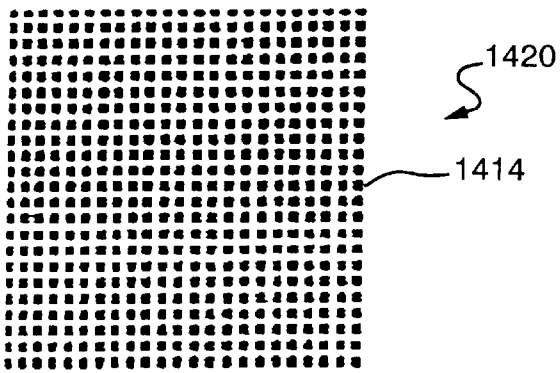
FIG. 14B depicts a second pattern for use with the pattern of FIG. 14A to form a registration mark to visually detect misalignment errors in two orthogonal directions.
Figure 14D:
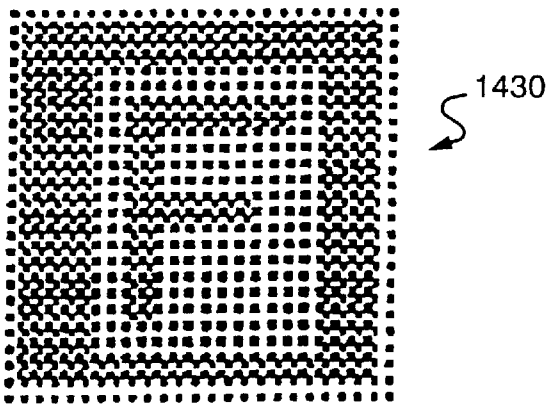
FIG. 14D depicts the registration mark formed with the patterns of FIGS. 14A and 14B with a horizontal and vertical misalignment error of 180°.
Figure 14A:
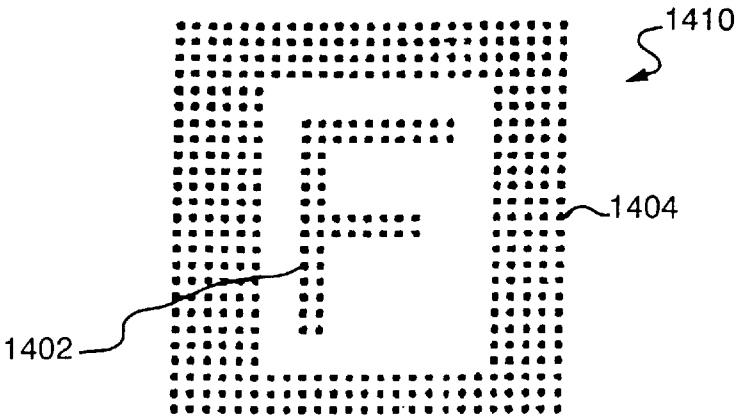
FIG. 14A depicts a first pattern with an embedded symbol for use in forming a registration mark to visually detect misalignments in two orthogonal directions.

FIG. 14A depicts a first symbol 1410 which includes spaced elements 1404 formed in an array having embedded therein a symbol 1402. The spaced elements 1404 are of equal width and equal length and are also equally spaced. The width, length and spacing of the elements 1404 can be established as desirable for the applicable implementation as will be understood by the skilled artisan. FIG. 14B depicts a second pattern 1420 which includes spaced elements 1414 formed in an array. The spaced elements 1414 are also equally spaced and of equal length and equal width. The spacing, i.e., pitch of the elements 1414 is identical to that of the elements 1404 of FIG. 14A. However, the width and length of each element 1414 is greater than that of each element 1404. Accordingly, the pattern depicted in FIG. 14B exceeds the density of the pattern depicted in FIG. 14A, even outside the border of the symbol 1402. This difference in the respective sizes of the elements 1404 and 1414 reflects the applicable acceptable misalignment error tolerance in the horizontal and vertical directions. If, however, no misalignment error could be tolerated, the elements 1404 and 1414 would be identical in size and spacing.

Figure 14C:
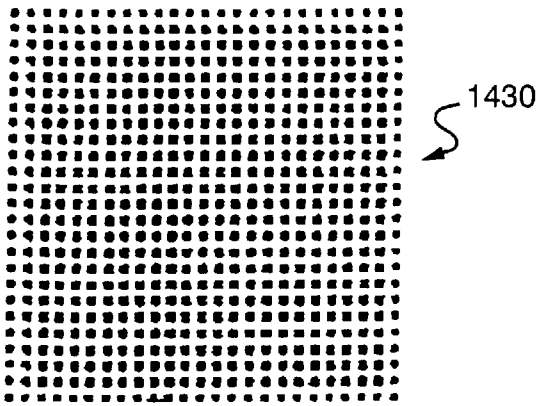
FIG. 14C depicts the registration mark formed with the patterns of FIGS. 14A and 14B in perfect alignment.
Figure 14F:
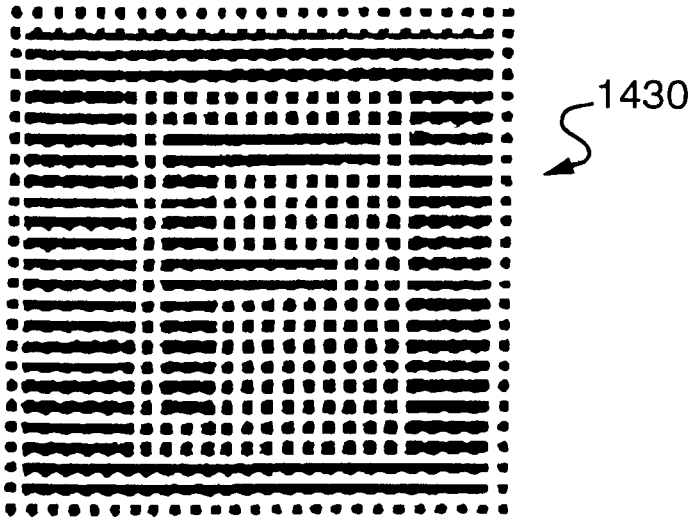
FIG. 14F depicts the registration mark formed with the patterns depicted in FIGS. 14A and 14B with a vertical misalignment error of 180°.
Figure 14E:
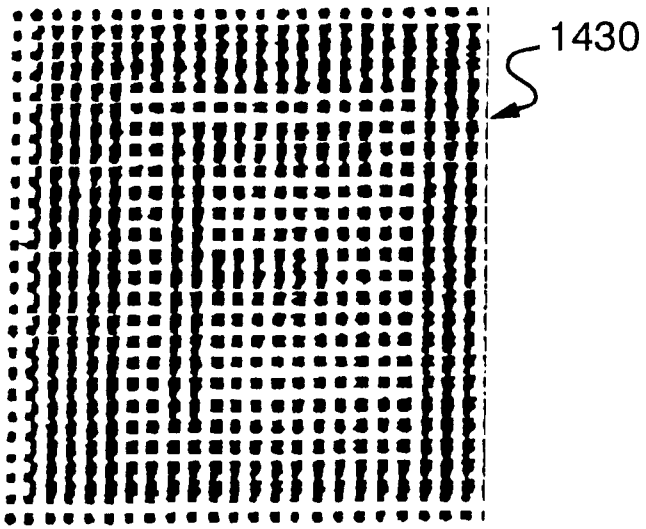
FIG. 14E depicts the registration mark formed with the patterns depicted in FIGS. 14A and 14B with a horizontal misalignment error of 180°.

FIG. 14C depicts a registration mark 1430 formed by superpositioning the patterns 1410 and 1420. As shown, the patterns are in perfect alignment. Accordingly, the embedded symbol remains masked. FIG. 14D depicts the registration mark 1430 with a 180° vertical and horizontal phase error. Accordingly, the symbol 1402 is now exposed and visually perceivable with the unaided eye. FIG. 14E depicts the registration pattern or mark 1430 with a 180° phase error in the horizontal direction. As indicated, the symbol 1402 is also unmasked by the horizontal alignment error so as to be visually perceivable with the unaided eye. FIG. 14F depicts the registration mark 1430 with a 180° phase error in the vertical direction. As shown, the symbol "F" is unmasked by the vertical alignment error so as to be visually perceivable with the unaided eye. Because the unmasked "F" varies to some extent dependent upon the direction or directions of the unacceptable misalignment error, the observer is also able to immediately detect the direction(s) of the misalignment error. It should be noted that the visibility of the exposed symbol will increase or decrease based upon the relative size of the symbol with respect to the pitch of the pattern. Accordingly to improve visibility, the size of the symbol is increased relative to the pitch of the pattern.

As will be discussed further below, the patterns themselves may be formed on different sheets of media and the respective sheets physically overlaid and aligned such that the patterns 10 and 20 are superpositioned to allow detection of an unacceptable misalignment error or to determine the degree of misalignment. Alternatively, the patterns may be formed, one on top of the other so as to be superpositioned on a single sheet of media. One pattern may be preprinted on a sheet of media and the other pattern formed so as to be superpositioned on the preprinted pattern to form the registration mark. If desired, the registration mark or the respective patterns may be formed at various locations on a single sheet of media.

It may be desirable to form one or both patterns multiple times in a superpositioned fashion to, for example, confirm the repeatability of the scan engine or offset printer over many sheets of media. More than two patterns could be utilized so that if multiple superpositioned patterns are used to form the registration mark, the particular pattern(s) which are misaligned can be specifically identified. Each of the multiple patterns may be of a different color to further enhance detection of any misalignment.

The pattern 10 depicted in FIG. 1A could, if desired, be formed in the four corners of several identical sheets of media. By offsetting the patterns 10 on each successive sheet by the width of the pattern 10, an array of patterns 10 is formed in the corners of each sheet. On a final sheet of the media, the pattern 20 can be formed multiple times at each of the four corners of the sheet in positions corresponding to those of the patterns 10 written on the other sheets of media. By overlaying the final sheet of media over each of the other sheets of media one at a time, a misalignment between any of the patterns 10 on the respective sheets of media and the pattern 20 on the final sheet of media which exceeds the position error tolerance can be easily detected with the unaided eye. If desired, one or more reference marks could also be simultaneously formed or preprinted on the final sheet to duplicate the appearance of registration mark 30 at predetermined phase errors for calibration purposes.

Figure 3A:
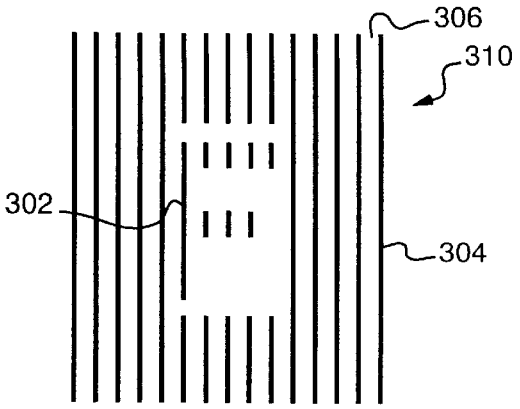
FIG. 3A depicts a first pattern, similar to that of FIG. 1A, for use in forming a registration mark in accordance with the present invention.

FIG. 3A depicts a first pattern 310 which is substantially similar to the pattern depicted in FIG. 1A. Pattern 310 is formed of multiple parallel lines 304 having a spatial frequency and duty cycle. The lines are separated by unwritten spaces 306. The pattern 310 includes an embedded symbol 302 which is again in the form of the alphabet character "F". The width and pitch of the lines 304 and the width of the spaces 306 are identical to those of the pattern 10 depicted in FIG. 1A.

Figure 3B:
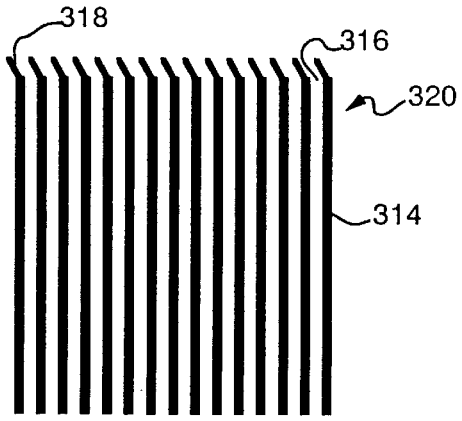
FIG. 3B depicts a second pattern having stepped segments for use in forming a registration mark in accordance with the present invention.

FIG. 3B depicts a second pattern 320 which, except for stepped segments 318, is substantially similar to the pattern depicted in FIG. 1B. The pattern 320 is formed of multiple parallel lines 314 having a spatial frequency and duty cycle. The lines are separated by unwritten spaces 316. The lines 314 are of equal width and pitch to those of lines 14 of pattern 20 shown in FIG. 1B. Accordingly, the width of the spaces 316 is also equal to the width of spaces 16 of pattern 20. Pattern 320 differs from pattern 20 in that pattern 320 includes stepped segments 318 extending from each of the lines 314.

As discussed above, in connection with FIGS. 1A and 1B, it should be understood that the spatial frequency and duty cycles of the patterns 310 and 320 are exemplary. The width of the lines 304 and 314 and the spaces 306 and 316 can be varied, as desired, for the particular implementation. As the width of the lines 314 are increased or decreased, beneficially the length of the respective stepped segments 318 will be similarly increased or decreased so as to at least extend across the full width of each of the lines 304 and preferably at least across the full width of lines 314.

Figure 3C:
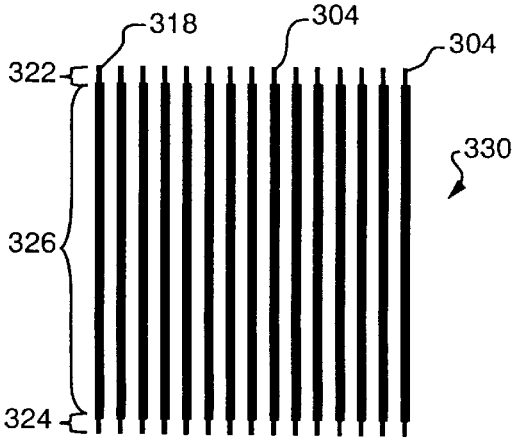
FIG. 3C depicts a registration mark formed with the patterns of FIGS. 3A and 3B indicative of 0° phase error.

FIG. 3C depicts the pattern 320 superpositioned over the pattern 310 to form a registration mark or pattern 330 with zero phase error. As shown in FIG. 3C, segments of the lines 304 of pattern 310 extend beyond the respective ends of the lines 314 of pattern 320 to form portions 322 and 324 of the registration mark 330 in a manner which is substantially similar to that described above in connection with registration mark 30. Extending from the respective ends of the lines 314 of the pattern 320 are the stepped segments 318 of the pattern 320. Hence, the portion 322 of the registration mark 330 includes stepped segments 318 superimposed over the extended portions of the lines 304. As will be further described below, the extended portion 322 of the registration mark 330 can be used to very precisely quantify to less than a pixel width, the extent of any misalignment of the patterns 310 and 320 even if that misalignment is within the acceptable position error tolerance.

Figure 3D:
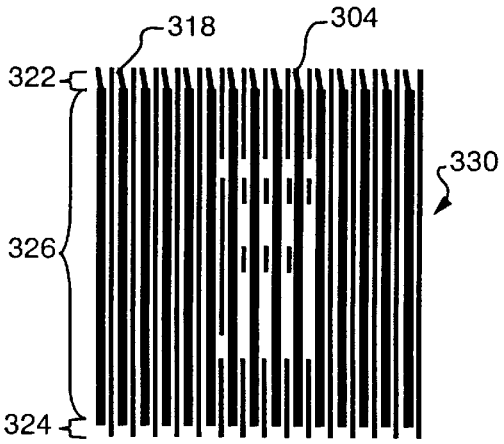
FIG. 3D depicts a registration mark formed with the patterns of FIGS. 3A and 3B indicative of 180° phase error.

Turning now to FIG. 3D, the registration mark 330 is depicted with the patterns 310 and 320 out of phase by 180°. As indicated, the embedded symbol 302 is fully unmasked by the misalignment. Additionally, the stepped segments 318 are also fully unmasked by the misalignment of the patterns 310 and 320 in the registration mark 330.

Figure 3E:
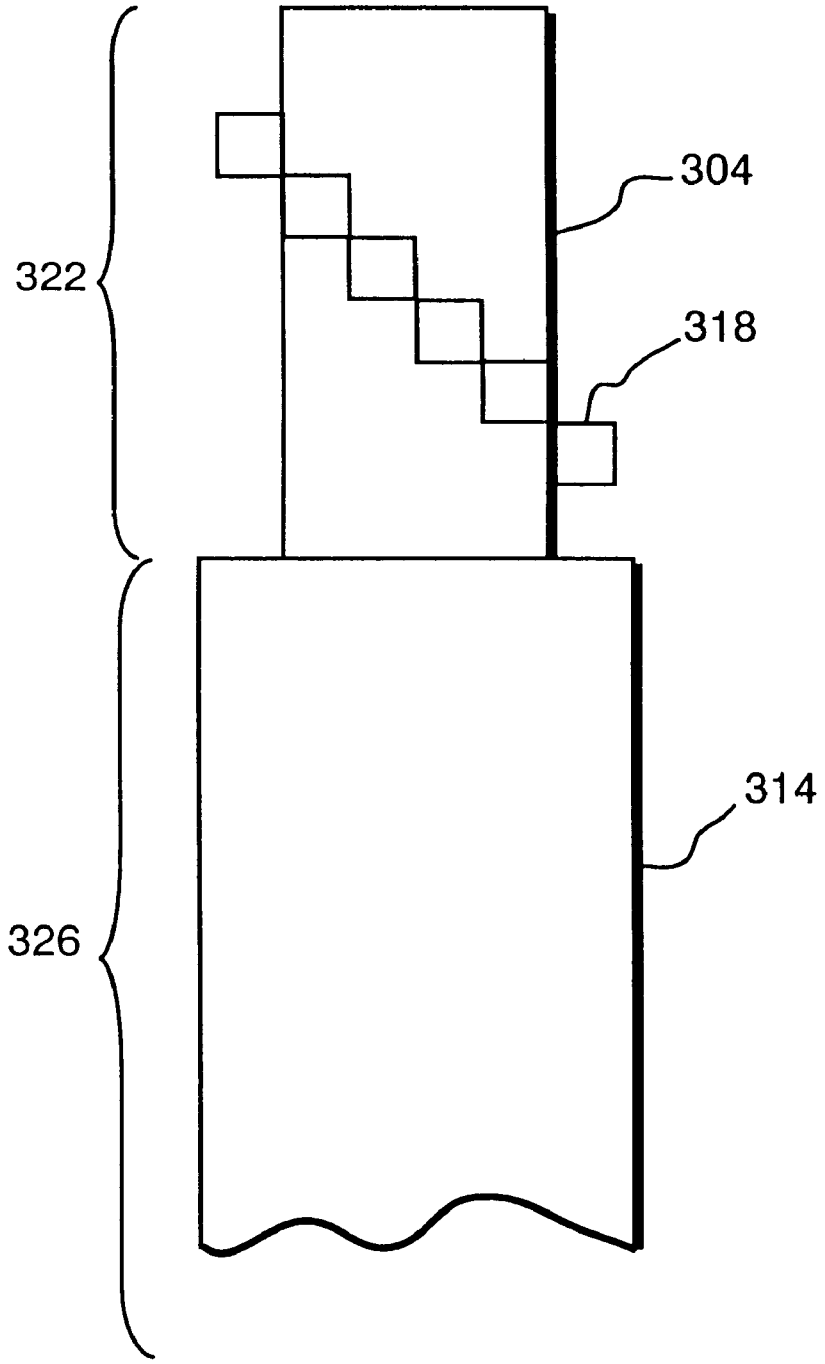
FIG. 3E depicts an expanded view of the extended portions of the patterns of FIGS. 3A and 3B in the registration mark of FIG. 3C.

FIG. 3E shows an expanded view of the portion 322 extending beyond the end of the portion 326 of the registration mark 330 with the patterns 310 and 320 aligned, as shown in FIG. 3C, i.e., in perfect alignment. As indicated in FIG. 3E, each of the stepped segments 318 is formed of multiple square steps which extend diagonally from one side of each of the lines 314 of the pattern 320 across each line 304 segment extending beyond the end of its associated line 314. The stepped segments are preferably contiguous, although this is not necessarily required, and continue to a point aligned with the other side of each of the respective lines 314.

As depicted, the stepped segments consist of six steps, each of which is approximately one pixel in height and width. Accordingly, any misalignment of the patterns 310 and 320 can be precisely determined to less than a pixel, i.e., less than 0.27 mil in the present example, by simply counting the number of blocks extending from either side of each respective line 314 to a point where a block becomes contiguous with, i.e., the stepped segments intersect, an adjacent side of the extending segment of the associated line 304. Once again, as discussed previously, a magnifying lens will typically be required to determine from the respective positioning of the stepped segment 318 and extended segment of line 304 the precise misalignment of the patterns 310 and 320. Hence, the use of the stepped segments 318 allows easy detection and quantification of the precise misalignment of the patterns 310 and 320 from the registration mark 330 without the need for complex measurement devices.

It will be understood that the angle of the stepped segments could be changed so as to intersect the upper end of the extended segment of each of the lines 304. In this way, both the vertical and horizontal misalignment could be precisely determined from a single registration mark. The stepped segments could be extended. It will also be understood that the actual dimensions of the steps may be varied as desirable for the particular implementation. For example, the steps could be of another shape, such as a rectangle or triangle. Further, the size of each step could be formed so as to have a length and width of any desired magnitude.

FIGS. 4A–F depict an expanded view of the portion 322 extending beyond the edge of the portion 326 of the registration mark 330 with various phase errors.

Figure 4A:
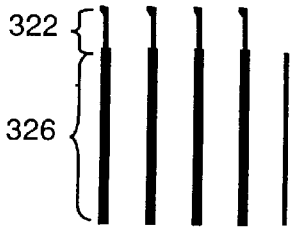
FIG. 4A depicts portions of the registration mark depicted in FIG. 3C.

FIG. 4A shows the registration mark 330 as depicted in FIG. 3C, i.e., with the patterns 310 and 320 in perfect alignment. Accordingly, as shown in FIG. 4A, the stepped segments 318 are as depicted in FIG. 3E.

Figure 4B:
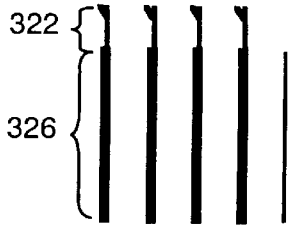
FIG. 4B depicts a portion of a registration mark similar to that depicted in FIG. 3C but with a phase error within an acceptable error tolerance.

FIG. 4B depicts the portions 322 and 326 of the registration mark 330 with the patterns 310 and 320 misaligned by one pixel. Here, the misalignment of the patterns 310 and 320 is within the position error tolerance for the given example. In FIG. 4B, the stepped segments 318 which are on the right hand side of the lines 314 are masked by the extending portions of the lines 304, while the stepped segments 318 are further unmasked on the left hand side of the extended segments of the lines 304.

Figure 4C:
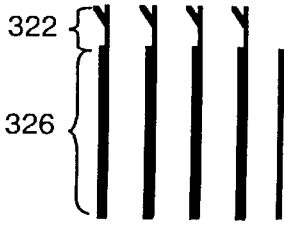
FIG. 4C depicts a portion of a registration mark similar to that depicted in FIG. 3C but with a phase error exceeding an acceptable error tolerance by one pixel.

FIG. 4C depicts the portions 322 and 326 of the registration mark 330 with a two pixel misalignment. As can be seen, additional stepped segments to the left of the extending portions of the lines 304 are unmasked because the misalignment error has increased.

Figure 4D:
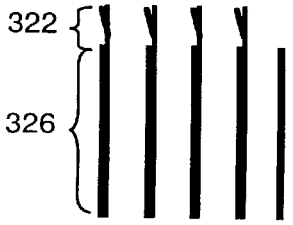
FIG. 4D depicts a portion of a registration mark similar to that depicted in FIG. 3C but with a phase error exceeding an acceptable error tolerance by two pixels.

FIG. 4D shows the portions 322 and 326 of the registration mark 330 as the horizontal misalignment continues to increase. As depicted in FIG. 4D, the error is now at three pixels and further unmasking of more of the stepped segments to the left of the extended segments of the lines 304 has occurred.

Figure 4E:
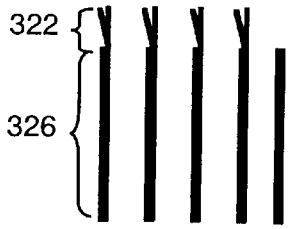
FIG. 4E depicts a portion of a registration mark similar to that depicted in FIG. 3C but with a phase error exceeding an acceptable error tolerance by three pixels.

FIG. 4E shows a misalignment of the patterns 310 and 320 of four pixels. The majority of the stepped segments are now unmasked to the left of the extended segments of the lines 304. In the present example, approximately two and one-half of the stepped segments on the right side of lines 314 remain masked by the extending segments of the lines 304.

Figure 4F:
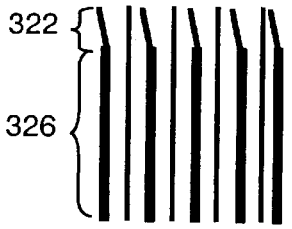
FIG. 4F depicts a portion of the registration mark shown in FIG. 3D.

FIG. 4F depicts the registration mark 330 with the patterns 310 and 320 misaligned by a phase error of 180°, as shown in FIG. 3D. The stepped segments 318 are now fully unmasked. At 180° phase error, the stepped segments 318 no longer intersect the lines 304. However, if desired, the stepped segments could be extended and angled so as to intersect the extended segments of lines 304 even at maximum misalignment.

As described above, the registration mark in accordance with the present invention, provides high visual magnification of micro-position errors so that they may be easily read with an unaided eye. The registration mark is relatively insensitive to process characteristics such as spot size, media gamma and media processing. By superpositioning a pair of fine line or screen patterns of the same spatial frequency, one pattern serves as a variable mask to unveil information embedded in the second pattern proportionate to a misalignment error. The relative phase between the two patterns creates the mask effect and the duty cycle modifies the point where the embedded symbol is unmasked.

The high fundamental spatial frequency of each pattern is modulated by a larger scale information bearing image which becomes progressively more visible with the increasing phase difference between the two patterns forming the registration mark. By using embedded images in one or both patterns, a wide variety of visual symbols having dimensions many times larger than the positioned error itself, can be displayed. The relative density change and/or unmasking of the embedded symbol provide a visual pass/fail indicator that a position error threshold has been exceeded. Because the density, as well as the unmasking of the symbol, increases linearly with the increase in the misalignment of the underlaying patterns, the invention is particularly suitable for use in an active feedback control system as will be discussed further below. The registration mark as described above is compact and suitable for photographic, offset printing or other image generation/replication processes where relative position errors between successive replicated images is critical and requires monitoring.

FIGS. 11A and 11B depict respective patterns somewhat different than those previously described which may advantageously be used to form a registration mark in accordance with the present invention.

As depicted in FIG. 11A, the registration mark 1110 is formed of multiple parallel lines 1104 which are substantially similar in width and spatial frequency to, for example, lines 304 of FIG. 3A. However, the length of the lines is somewhat shorter than lines 304 of the pattern 310 of FIG. 3A. Like the pattern 310, the pattern 1110 of FIG. 11A may include a symbol (not shown) embedded therein similar to those previously discussed above. The pattern 1110 also includes line segments 1130 which are shown to extend above, but could also extend below lines 1104. As indicated, the line segments 1130 are substantially narrower than the width of the lines 1104. For example, as shown, the lines 1104 have a width of four pixels and the lines 1130 have a width of one pixel. By selecting a width of the line segments 1130 which is substantially narrower than the width of the line segments 1104, the ease and accuracy of determining, i.e., quantifying, the position error to less than the minimum line width capacity of the printing system, e.g. one pixel, is enhanced.

As indicated, pattern 1110 also includes wedged or stepped segments 1118 which extend diagonally. Each step segment is advantageously rectangular in shape. This lengthening of each step segment as, for example, compared with the square step segments depicted in FIG. 3E, improves their visibility, under a microscope and their insensitivity to position errors in the orthogonal, i.e., vertical, direction. This is because the minimum line widths involved are approaching the resolution limits of the system. It should further be noted, that as compared to previously described first patterns, the portion of the pattern extending above lines 1104 could be in phase with lines 1104 but, as shown, may also be out of phase with lines 1104. In this regard, the lines 1104 and the line segment and step segments 1130 and 1118 are, in a general sense, completely independent position sensors. The only requirement being that both consistently show a zero error when there is in fact zero error.

FIG. 11B depicts a second pattern 1120 having lines 1128 which have an identical spatial frequency and width as line segments 1130 of pattern 1110. Accordingly, the spacing between the lines 1128 and between the lines 1130 is identical. As depicted in FIG. 11B, the lines 1128 are actually formed of spaced elements to enhance detectability. Pattern 1120 also includes line segments 1114 which have a spatial frequency and width identical to that of lines 314 of pattern 320 of FIG. 3B. Further, the length of both lines 1104 and 1114 are the same as the length of lines 314 of FIG. 3B. The pattern 1120 is of a lesser density than the pattern 1110.

FIG. 11C depicts a superpositioning of the patterns shown in FIGS. 11A and 11B with zero degree phase error. As shown, the resulting registration mark 1135 has a portion 1122 which is formed by the superpositioning of the step segments 1118 and lines 1130 over the lines 1128. Portion 1122 can be utilized to quantify the misalignment error. The registration mark 1135 also has a portion 1126 which includes the embedded symbol in the pattern 1110 to provide a highly visible indicator of unacceptable misalignment between the patterns 1110 and 1120 which can be perceived with the unaided eye as described in detail above. The portion 1122 of the registration mark provides a high resolution calibration pattern which, with the aid of a magnifying lens can be used to precisely determine the extent misalignment errors to a fraction of a pixel. It should be noted that the elements forming lines 1128 are selected such that the intersection of stepped segments 1118 and lines 1128 is framed by an "E" or reversed "E" above and below the intersecting step. This framing serves to aid visual perception of the intersection of the patterns.

FIG. 12A depicts a first pattern 1210 which includes step segments 1218 and line segments 1230 which are separated by spaces 1208. FIG. 12B depicts a second pattern 1220 which is formed of lines 1228 with spaces 1208 therebetween. The pattern 1220 has a spatial frequency equal to that of pattern 1210. The lines 1228 and 1230 and each of the steps forming the stepped segments 1218 are a single pixel in width. The patterns 1210 and 1220 are substantially similar to the extending portions of the patterns 1110 and 1120 of FIGS. 11A and 11B. No density change will occur and no symbol will be unmasked by the misalignment of the respective patterns.

FIG. 12C depicts the registration mark 1235 formed by superpositioning patterns 1210 and 1220. As depicted in FIG. 12C, a minus two pixel error is precisely determinable from the registration mark 1235. FIG. 12D depicts the registration mark 1235 with a minus one pixel error. FIG. 12E depicts the registration mark 1235 with the patterns 1210 and 1220 in perfect alignment.

Turning now to FIG. 12F, the registration mark 1235 is depicted with a position error of one pixel. FIG. 12G depicts the registration mark when the misalignment between the superpositioned patterns 1210 and 1220 has become two pixel errors. Finally, FIG. 12H depicts the registration mark 1235 with the misalignment error at three pixels.

FIGS. 13A–13B depict alternative patterns, including stepped segments, which can be superpositioned to form a registration mark suitable for position error detection in accordance with the present invention.

FIG. 13A depicts a first pattern 1310 which includes a stepped wedge portion 1318 and multiple varying length lines 1304 which are of equal width and spacing. The pattern also includes a segmented line 1330 at the upper and lower portions of pattern 1310.

FIG. 13B depicts a second pattern 1320 formed of a single segmented or dashed line 1328 which is substantially similar to one of the lines 1228 depicted in FIG. 12B.

The lines 1304 and 1328 and the step segments of the wedge 1318 are shown as one pixel in width to achieve maximum resolution of a horizontal position error. The lines 1304 are aligned with every other step of the wedge 1318. The lines 1304 are separated by unwritten spaces which also have a single pixel width.

As in the case of pattern 1220 of FIG. 12B, pattern 1320 is formed as a single vertical line modulated to create a line weight, i.e., density, that is different than that of the lines 1304 and 1330 of pattern 1310 to provide sufficient contrast between the lines of pattern 1310 and line of pattern 1320 so that when superpositioned, the patterns can be easily distinguished.

The stepped wedge 1318 is particularly advantageous for quantifying the position error as will be discussed further below with reference to the registration mark formed by the superpositioning of the patterns 1310 and 1320. The lines 1304 of pattern 1310 provide a one pixel "on" by one pixel "off" line pattern which serves as a vernier scale to increase the resolution of the position error. More particularly, the lines 1304 create channels which frame the modulated line 1328 of pattern 1320 when it falls between the lines 1304 in the registration mark formed by the superpositioned patterns.

FIG. 13C depicts the registration mark 1335 formed by the superpositioning of patterns 1310 and 1320. As depicted, the registration mark is indicative of a perfect alignment, i.e., zero position error, between the respective patterns 1310 and 1320. Line 1330 is aligned with line 1328 to clearly indicate proper alignment of the patterns 1310 and 1320.

FIG. 13D depicts the registration mark 1335 with a position error of one pixel. As indicated, when the misalignment equals an odd number of pixels, the line 1328 is masked by one of the lines 1304. The direction of the misalignment is easily determined by the relationship between the line 1330 and the line 1328. Further, the wedge 1318 provides a precise indicator of the amount of the error, i.e., one pixel. The masking and unmasking of the line 1328 by the lines 1304 increases the resolution of the position error.

FIG. 13E depicts the registration mark 1335 with a two pixel error. Because the misalignment equals an even number of pixels, the line 1328 falls within an unwritten space separating lines 1304. The visibility of the line 1328 is, as can be seen, highly enhanced, due to its framing by the adjacent lines 1304. The effect on the registration mark 1335 is to have a relatively high density area which is three pixels in width. The significant visual contrast in the registration mark 1335 between the one pixel error depicted in FIG. 13D and the two pixel error depicted in FIG. 13E results from the line 1328 being partially masked in FIG. 13D and completely exposed in FIG. 13E.

FIG. 13F depicts the registration mark 1335 with a two and one-half pixel error. As indicated, a portion of the width of the line 1328 is masked by one of the lines 1304. The exposed portion of the width of line 1328 between lines 1304 is framed to enhance visible detection by providing a high density area over a three pixel width. The visual highlighting or framing of the exposed portion of line 1328 of registration mark 1335 in FIG. 13F allows the observer to easily determine the fractional pixel error by estimating the proportion of line 1328 which remains exposed in FIG. 13F.

Sample registration marks representing various error states could, if desired, be utilized to provide a visual comparison reference against which the registration mark 1335 or other registration marks could be compared to provide a further visual aid for precisely quantifying the misalignment error. The orthogonal axis modulation of pattern 1320 could be adjusted to further enhance visual detection of misalignments. For example, the pitch and phase of the line 1328 modulation could correspond to the modulation of the lines 1304 of pattern 1310 so as to create an interlocking relationship by modulating the respective lines 180° out of phase.

It will be recognized by those skilled in the art, that although various patterns have been shown, other patterns could be utilized in accordance with the present invention to visually indicate misalignment errors in accordance with the present invention, as described herein. As described above, the use of symbols and masking in accordance with the present invention allows the visual enhancement of misalignment errors.

Figure 5A:
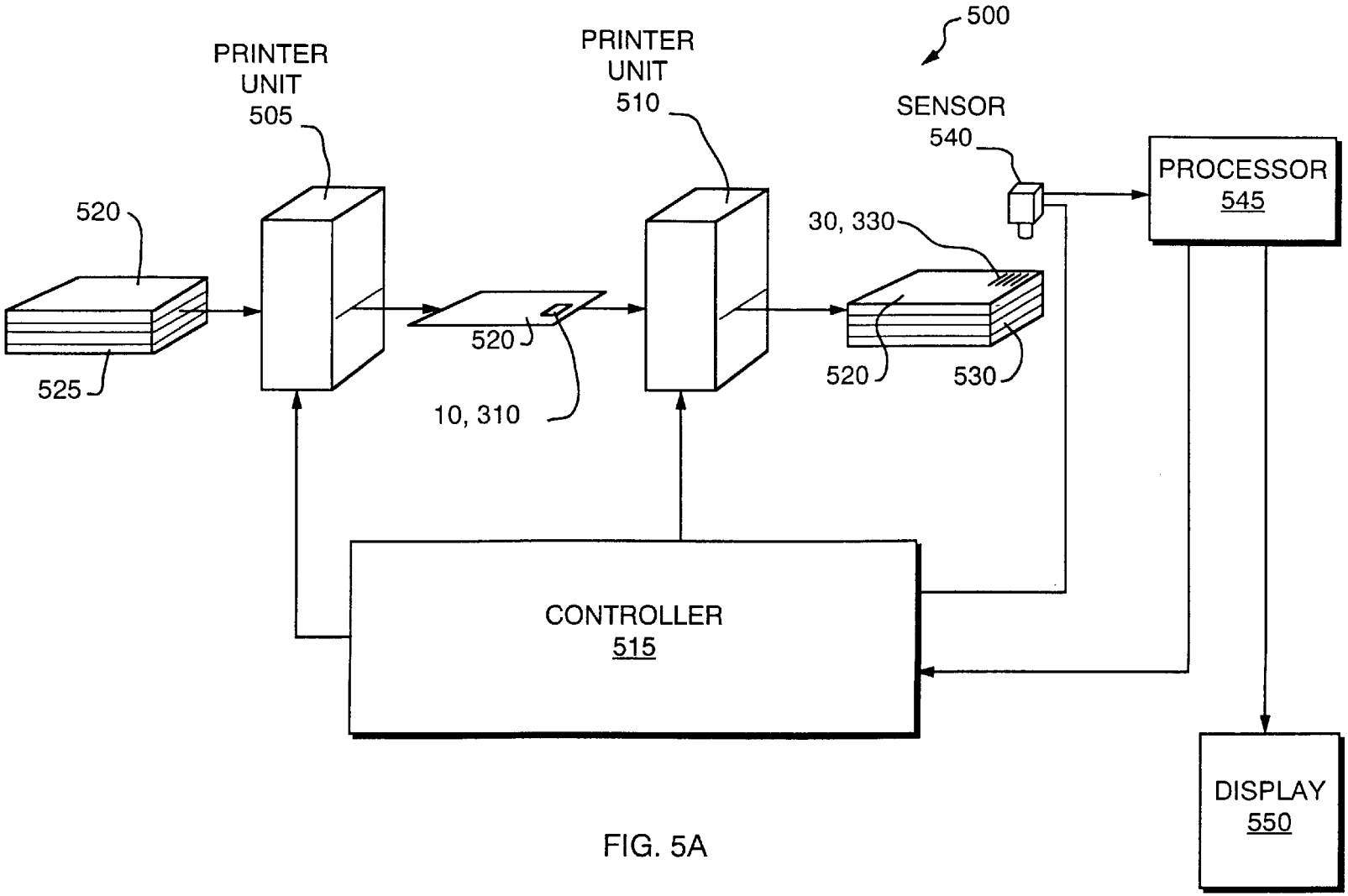
FIG. 5A depicts prepress scanner housed within the printer units of FIG. 5.
Figure 5B:
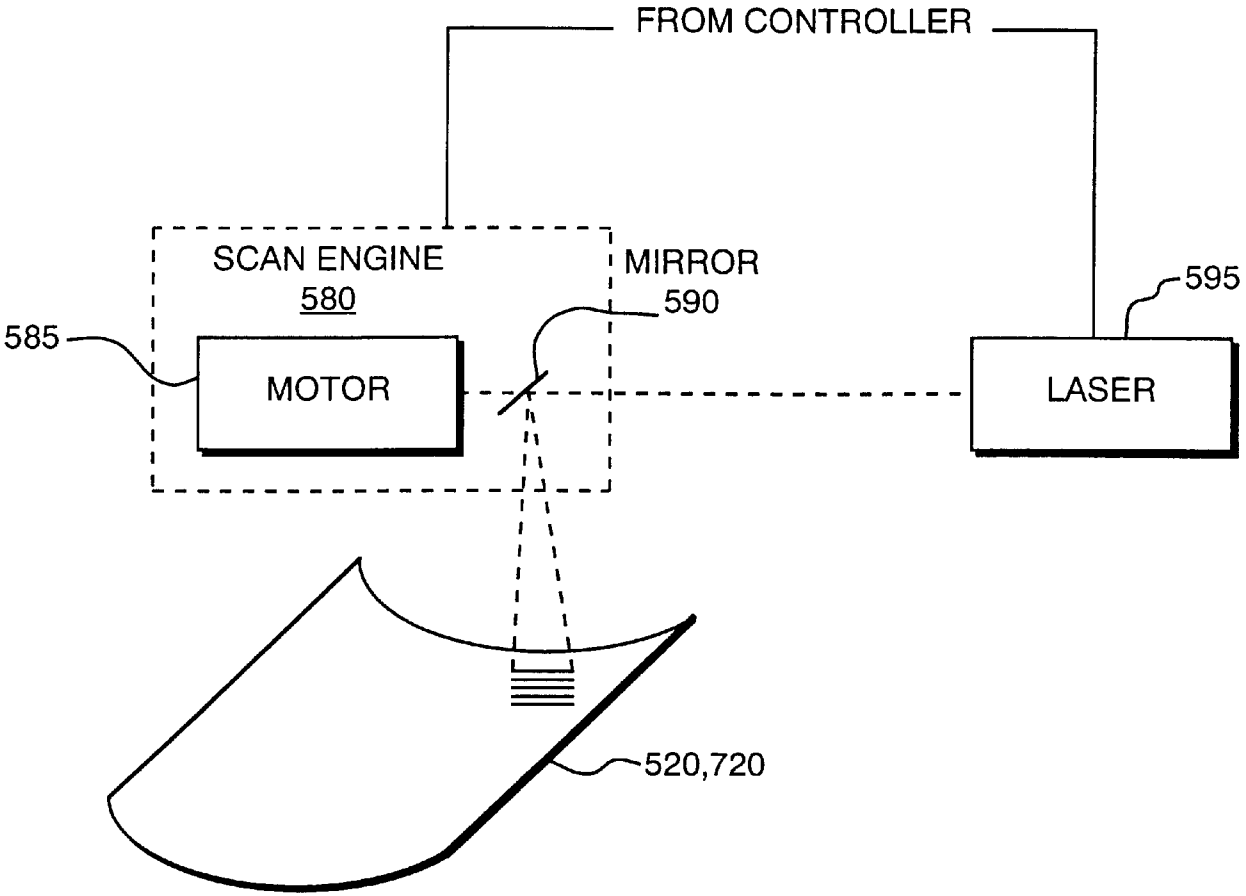
FIG. 5B depicts offset printer components alternatively housed within the printer units of FIG. 5.
Figure 5C:
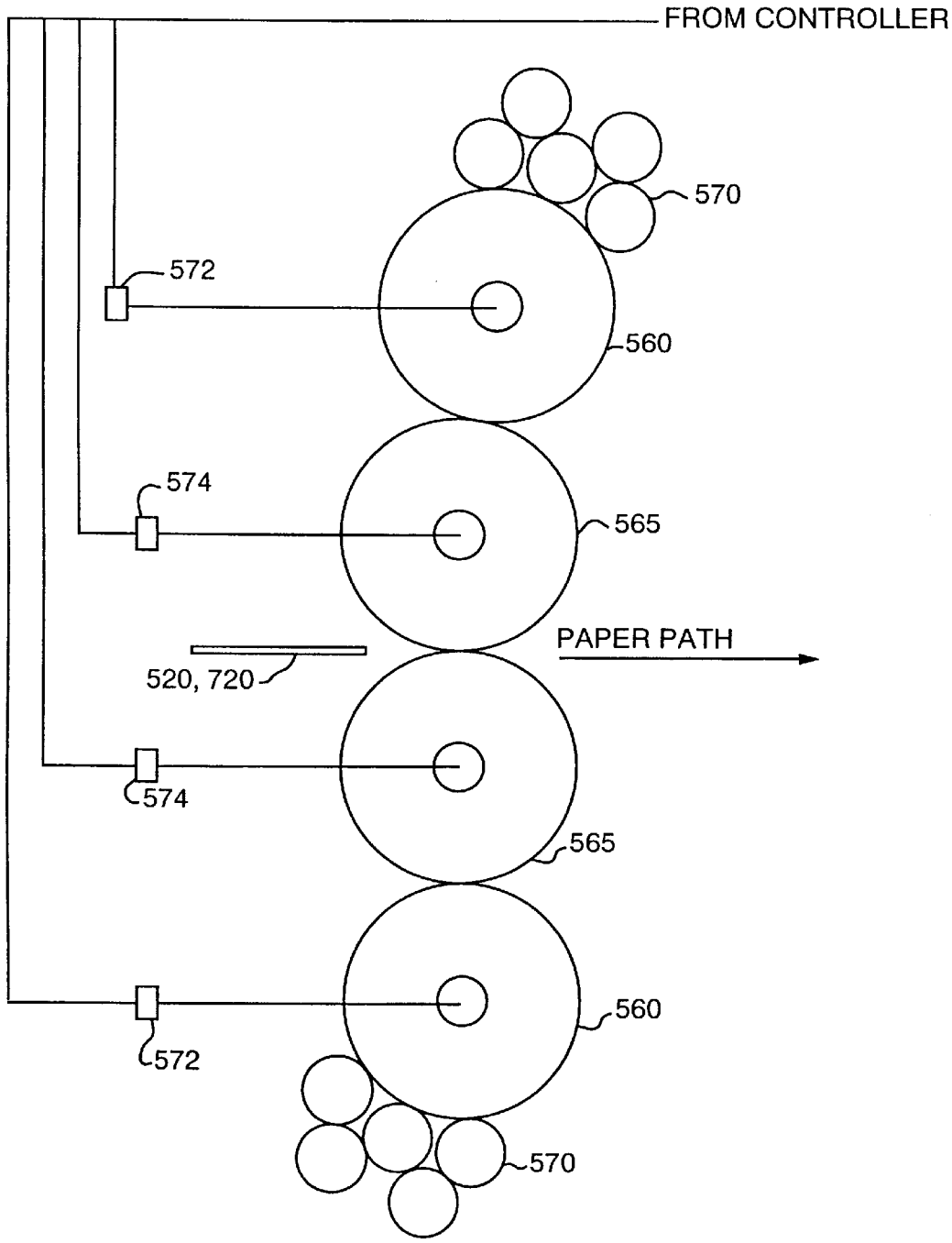
FIG. 5 depicts a system for implementing image position error detection in accordance with the present invention.

FIG. 5 shows a system 500 for implementing the above-described technique. As depicted, the system 500 includes a first printer unit 505 and a second printer unit 510, both of which are controlled by the controller 515. Individual sheets of media 520 from the stack of media 525 are fed sequentially through printer units 505 and 510. The sheets exit the second printer unit 510 onto the media stack 530. Each of the printer units 505 and 510 include a cylindrical drum (not shown) into which the individual sheets of media 520 are drawn and mounted prior to imaging.

As shown in FIG. 5A, if the printer units 505 and 510 are part of a prepress system, each will house a scan engine 580 which includes a motor 585 which drives the spin mirror 590 or other spun deflector element during imaging operations. Each of the printer units 505 and 510 will also include a laser 595 or other radiation source for emitting a beam of radiation to impinge upon the spin mirror 590 and be reflected thereby so as to scan across the medium 520 mounted within the cylindrical drum (not shown). Although a cylindrical drum type system is depicted, it will be recognized that the technique is equally applicable to prepress imaging systems in which the medium to be recorded or read is mounted on a flat surface.

As shown in FIG. 5B, if the printer units 505 and 510 are part of a lithographic or offset printing system, each will house plate cylinders 560 and blanket cylinders 565 for transferring images onto the media 520 or 720 passing along a path which is indicated in FIG. 5B as a paper path. The plate cylinders will be respectively inked by inking systems 570. Each of the cylinders is driven by the drive devices 572 for the plate cylinders and 574 for the blanket cylinders 565. The drive devices are controlled by the controller 515 depicted in FIG. 5.

Referring again to FIG. 5, the system 500 also includes a sensor assembly 535 which could be a camera, photodetector, CCD or other type imaging device suitable for reading the respective patterns 10 and 20, or the registration mark 30, as applicable. Of course, other patterns or marks could be formed.

In the system 500, the sensor assembly 540 includes a camera. The sensor assembly 540 is connected to a processor 545 which receives the digitized output signals from the sensor assembly 540. The processor 545 is programmed to process the received digitized signal and generate output signals to the display 550 for viewing by a system operator and/or to the controller 515 for controlling the printer units 505 and 510, and specifically, the scan engine 580 or rollers 560, 565, to form the patterns in the desired position on the individual sheets of media 520 as they pass through the printers 505 and 510.

In operation, individual sheets of the media 520 are drawn from the media stack 525 into print unit 505. In the case of prepress operations, the controller 515 controls the scan engine 580 of print unit 505 such that the spin mirror 590 is driven by the motor 585 to direct the radiation beam from the laser 595, which is also controlled by signals from the controller 515, to scan the medium 520 to create the first pattern 10, which is detailed in FIG. 1A, on the medium 520. The medium 520 is then passed to the printer unit 510 which is driven by the controller 515 such that its scan engine 580 and laser 595 are operated to scan the radiation beam emitted from its laser 595 to form a second pattern 20, as detailed in FIG. 1B, superpositioned on the first pattern 10 on the medium 520.

In the case of offset printing, the controller 515 controls the drive devices 572, 574 to control the operation of the rollers 560, 565 to form the first pattern 10, which is detailed in FIG. 1A, on the medium 520. The medium 520 is then passed to the printer unit 510 which is driven by the controller 515 such that the devices 572, 574 are operated to drive the rollers 560, 565 rotate to form the second pattern 20, as detailed in FIG. 1B, superimposed on the first pattern 10 on the medium 520.

The medium 520 exits the printer unit 510 onto the media stack 530 with the registration mark 30 formed thereon. The sensor assembly 540 is controlled by the controller 515 to image the register mark 30 on sheet 520 and generate a digitized output signal representing the registration mark 30 which is transmitted to the processor 545.

The processor 545 processes the signal received from the sensor assembly 540 and generates an output signal to the display 550. The display 550 provides a picture of the registration mark 30 on its screen for viewing by the system operator. The processor 545 also transmits an output signal to the controller 515 to indicate either satisfactory alignment of the patterns 10 and 20 forming the registration mark 30 or a misalignment error in the patterns 10 and 20 exceeding a predefined tolerance. In this latter case, the controller 515 either automatically directs an adjustment in the operation of one or both of printer units 505 and 510, or directs the printer units to cease printing operations adjustment will not correct the error. It will be understood by those skilled in the art that in offset printing type operations, the registration mark will typically be used on a real time basis to continually monitor the printed media during production operations. However, in prepress operations, the registration mark is more likely to be used in a setup stage prior to a production run and in diagnostic testing either during installation or servicing of the printer units. Accordingly, continuous tracking, although available if desired, will normally not be utilized in prepress operations.

If desired, the transmission of the feedback control signals to the controller 515 and/or the transmission of output signals to the display 550 could be eliminated. If signals are not transmitted to the controller 515, the system operator would be responsible for directing adjustments or shutting down the system if the displayed registration mark indicates a misalignment error exceeding the predetermined error tolerance. If signals to the display 550 are eliminated, the controller 515 would be relied upon to automatically direct adjustments to the operation of the print units to correct the misalignment error or to shut down printing operations if unacceptable and uncorrectable misalignments are detected by the sensor assembly 540.

In this latter case, the sensor assembly 540 could be configured to detect only the density of the registration mark 30 and the processor 545 might include a comparator circuit or lookup table to determine whether the sensed density is no greater than a threshold density reflecting alignment of the patterns 10 and 20 within the acceptance threshold. Alternatively, the sensor assembly 540 could be configured to detect the symbol 2, if exposed, to determine if misalignment of the patterns exceeds the position error tolerance. Even if the display is eliminated, the system operator may view the registration mark 30 as the medium 520 is placed on the media stack 530 to determine with an unaided eye whether or not the embedded symbol 2 has been exposed. In this way, the system operator can verify either an unacceptable misalignment of the patterns 10 and 20, or that the patterns are properly aligned.

Figure 6:
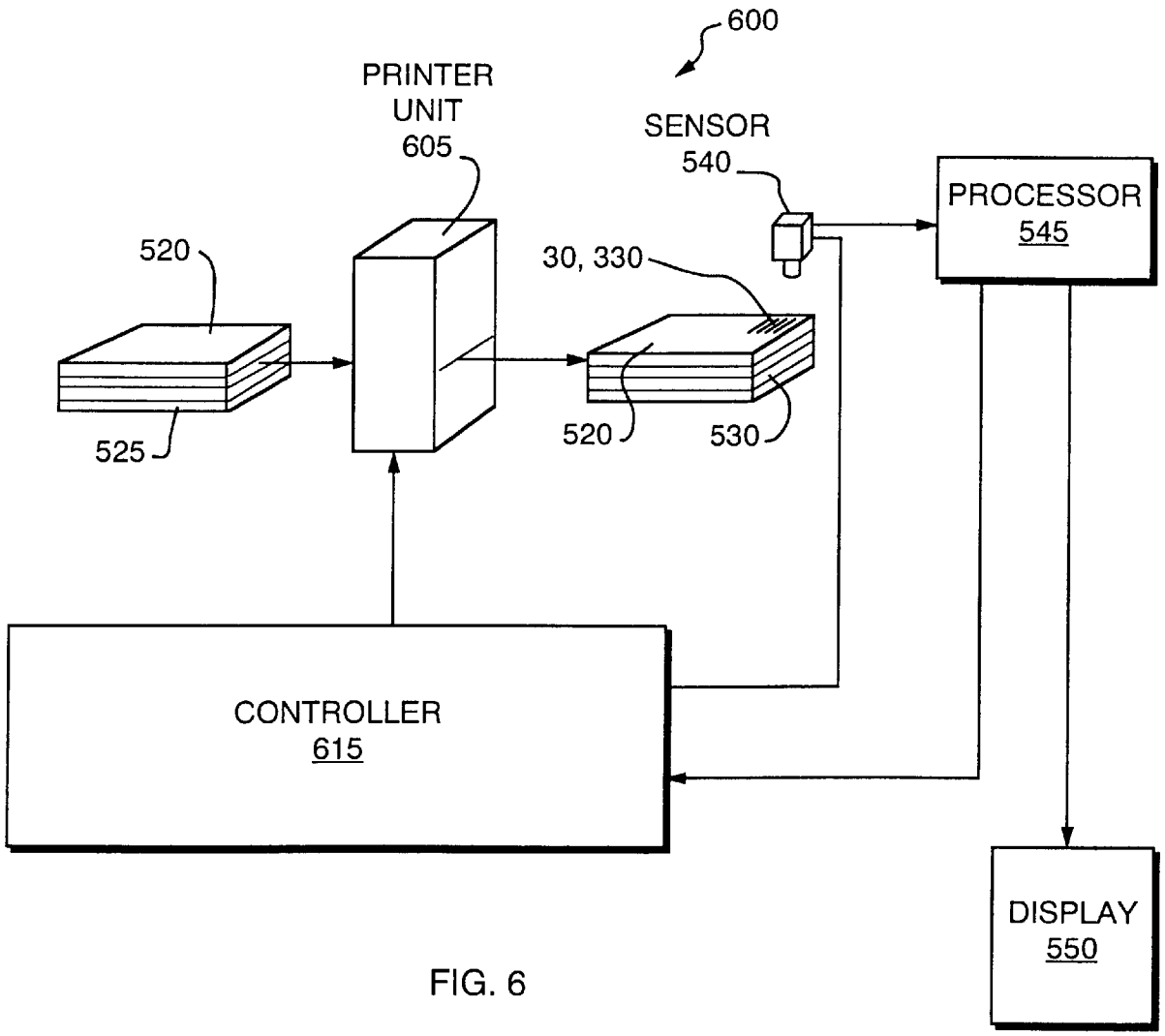
FIG. 6 depicts another system for implementing image position error detection in accordance with the present invention.

FIG. 6 depicts a further system 600 suitable for implementing the above described technique. As shown, the system 600 includes a single printer unit 605 which is substantially similar to the respective units 505 and 510. The printer unit 605 may include a radiation beam source and scan engine as depicted in FIG. 5A, or rollers and inking systems as depicted in FIG. 5B. The sensor assembly 540, processor 545 and display 550 are identical to those previously described with reference to FIG. 5 and accordingly, are identified with the same reference numerals.

In this particular implementation, the printer unit 605 is driven by the controller 615 such that the printer unit 605 is driven to form both patterns 10 and 20 on the medium 520. More particularly, the printer unit 605 is driven to first form the pattern 10 depicted in FIG. 1A on the medium 520. The controller also drives the printer unit 605 to superposition the pattern 20 detailed in FIG. 1B on pattern 10, to create a registration mark 30 as, for example, detailed in FIGS. 1C–1D. Accordingly, only a single scanner is required to form the registration mark on the medium.

Figure 7:
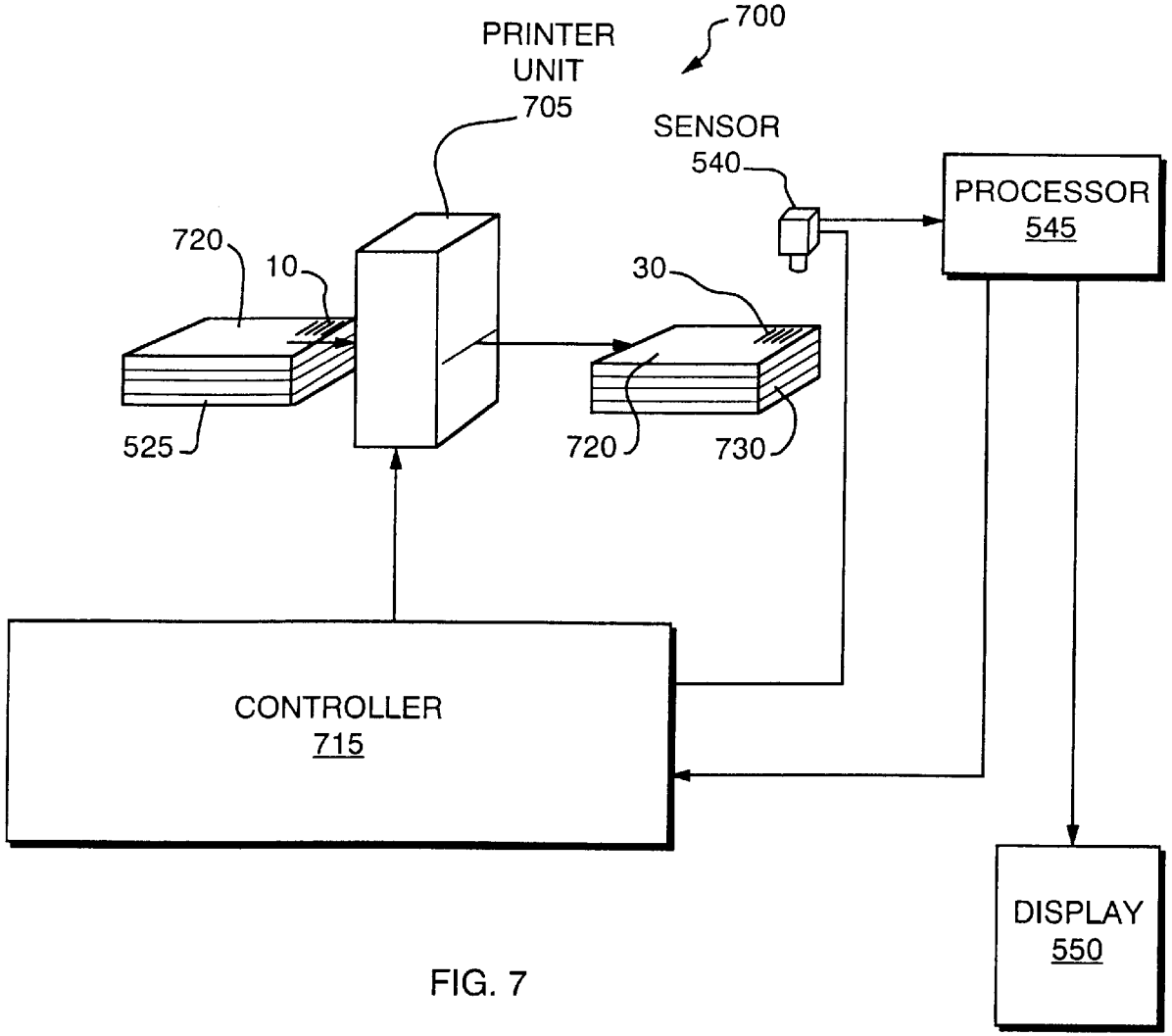
FIG. 7 depicts still another system for implementing image position error detection in accordance with the present invention.

FIG. 7 depicts another system 700 suitable for implementing the above described technique. The sensor assembly 540, processor 545 and display 550 are identical to those previously described. The system 700 differs from the system 600 in that the media 720 include a pattern 10 which is preprinted thereon prior to being placed in stack 725. The medium 720 is drawn into the printer unit 705 which is similar to the previously described printer units and includes a scan engine 580 and laser 595, as depicted in FIG. 5A, or the rollers 560, 565 and inking systems 570 shown in FIG. 5B. Because of the preprinting of the pattern 10 on the respective sheets of media, the controller 715 drives the printer unit 705 to write only the image 20 superpositioned over preprinted image 10, on medium 720 to create the registration mark 30 which is sensed by the sensor assembly 540. The feedback control and display functions are identical to those previously described and accordingly will not be reiterated to avoid unnecessary duplication.

Figure 8:
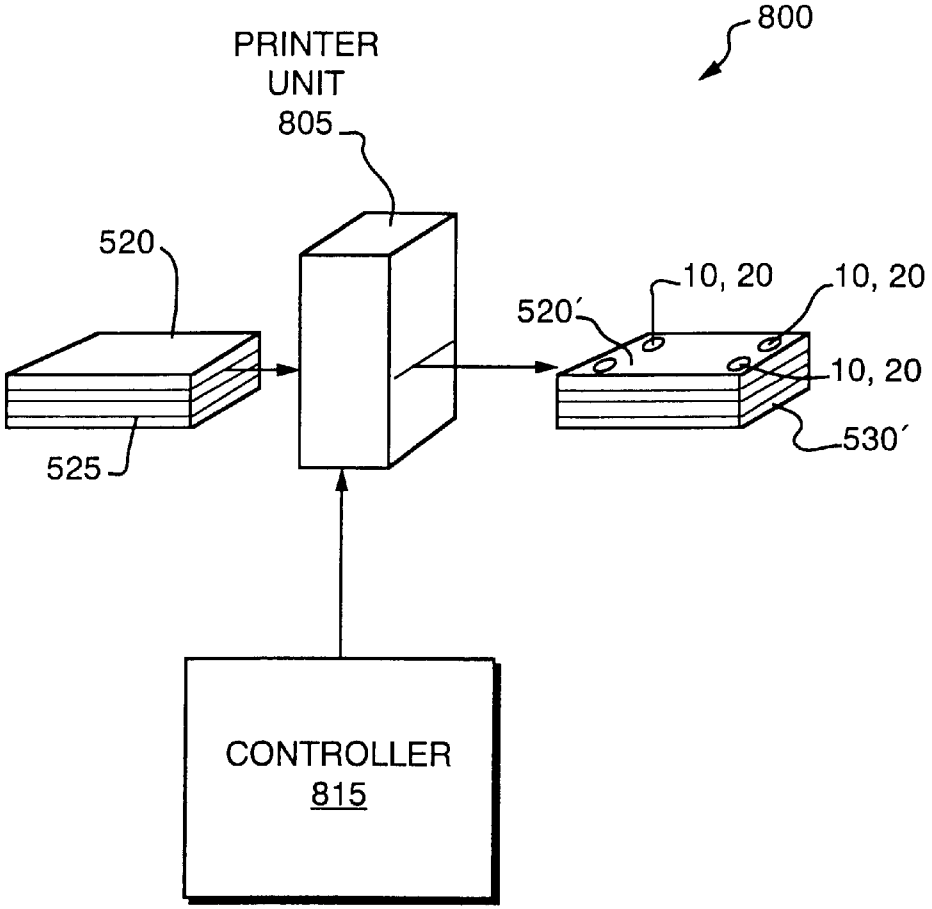
FIG. 8 depicts a somewhat simplified system for implementing image position error detection in accordance with the present invention.

Turning now to FIG. 8, yet another system 800 suitable for implementing the above described technique is depicted. The system 800 includes a printer unit 805 which is substantially similar to the previously described printer units and includes a scan engine 580 and laser 595 as depicted in FIG. 5A or rollers 560, 565 and inking system 570 of FIG. 5B.

The printer unit 805 is controlled by the controller 815. Individual sheets of media 520 are drawn from the media stack 525 into the printer unit 805. The printer unit 805 is driven by the controller 815 to form pattern 10 detailed in FIG. 1A and pattern 20 detailed in FIG. 1B respectively on every other sheet 520 drawn from the media stack 525 into the printer unit 805.

Each sheet of medium 520 exiting the printer unit 805 onto media stack 530' will have either the pattern 10 or the pattern 20 written thereon. Medium 520 depicted in FIG. 8 must necessarily be transparent so that the physical overlaying of individual sheets of media 520 superpositions pattern 20 over pattern 10 to create a registration mark 30 which is visible to the system operator.

Figure 9B:
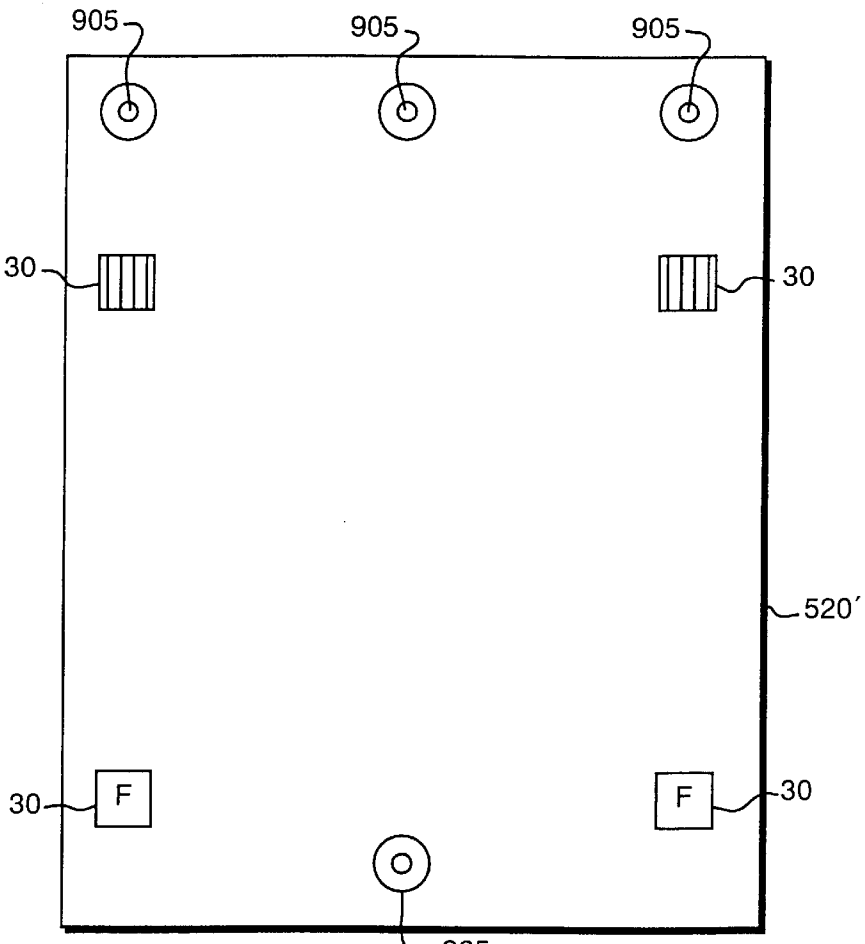
FIG. 9B shows the creation of registration marks which indicate unacceptable repeatability by physically overlaying individual sheets of media with different patterns written thereon.
Figure 9A:
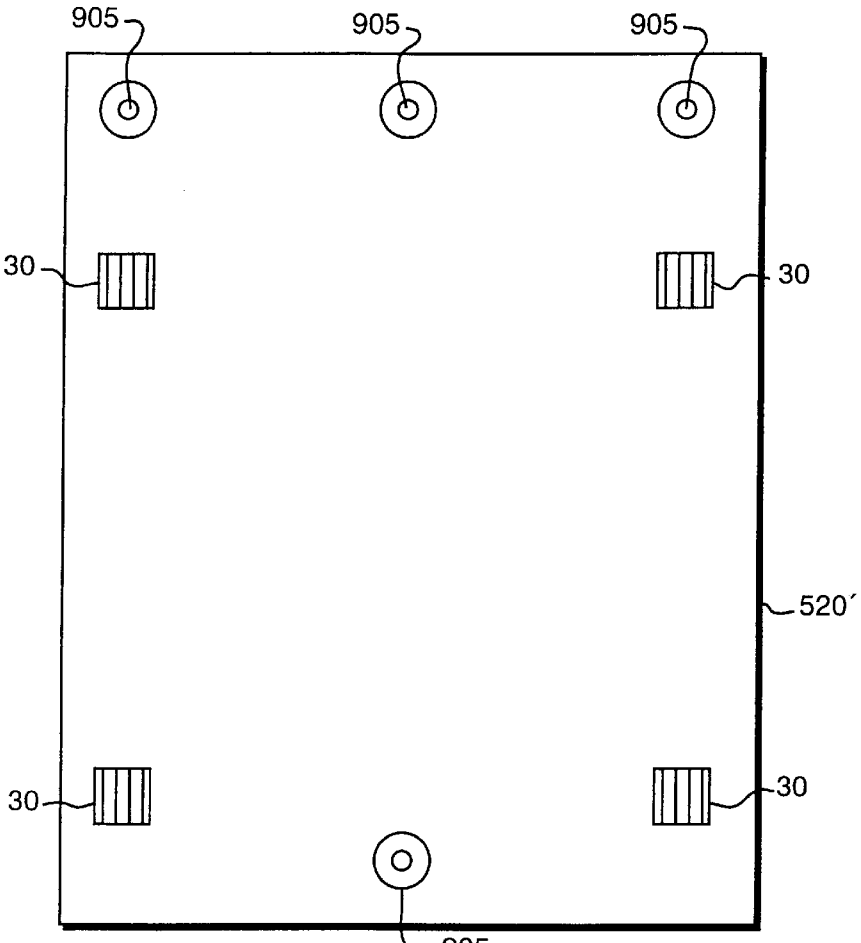
FIG. 9A shows the creation of registration marks which indicate acceptable repeatability by physically overlaying individual sheets of media with different patterns written thereon.

Referring to FIGS. 9A and 9B, the paired sheets of media 520' exiting the printer unit 805 are overlaid and aligned to create the registration mark 30. As shown in FIG. 9A, the two sheets of media 520' are overlaid and aligned by a set of precise registration pins 905, thereby creating the registration mark 30 in the four corners of the sheet pair. It will be understood that the top sheet 520' could include either of pattern 10 or pattern 20 so long as the bottom sheet has the other pattern written thereon. In FIG. 9A, the embedded symbol 2 in pattern 10 is not exposed in any of the registration marks 30. Accordingly, by viewing the sheet pair depicted in FIG. 9A, the system operator can visibly confirm with an unaided eye that the alignment of patterns 10 and 20 are within tolerance and the repeatability of the printer unit 805 is satisfactory.

FIG. 9B also depicts four registration marks 30 created by overlaying and aligning an associated pair of sheets of media 520'. As shown, the symbol 2 embedded in pattern 10 is not exposed in the upper two registration marks 30. However, the embedded symbol 2 is exposed in the lower two registration marks 30. Accordingly, by visually inspecting the overlaid sheets 520', the system operator is provided with a visible indication that the misalignment of the patterns is outside of the required threshold and that the repeatability of the printer unit 805 is unacceptable.

Figure 10:
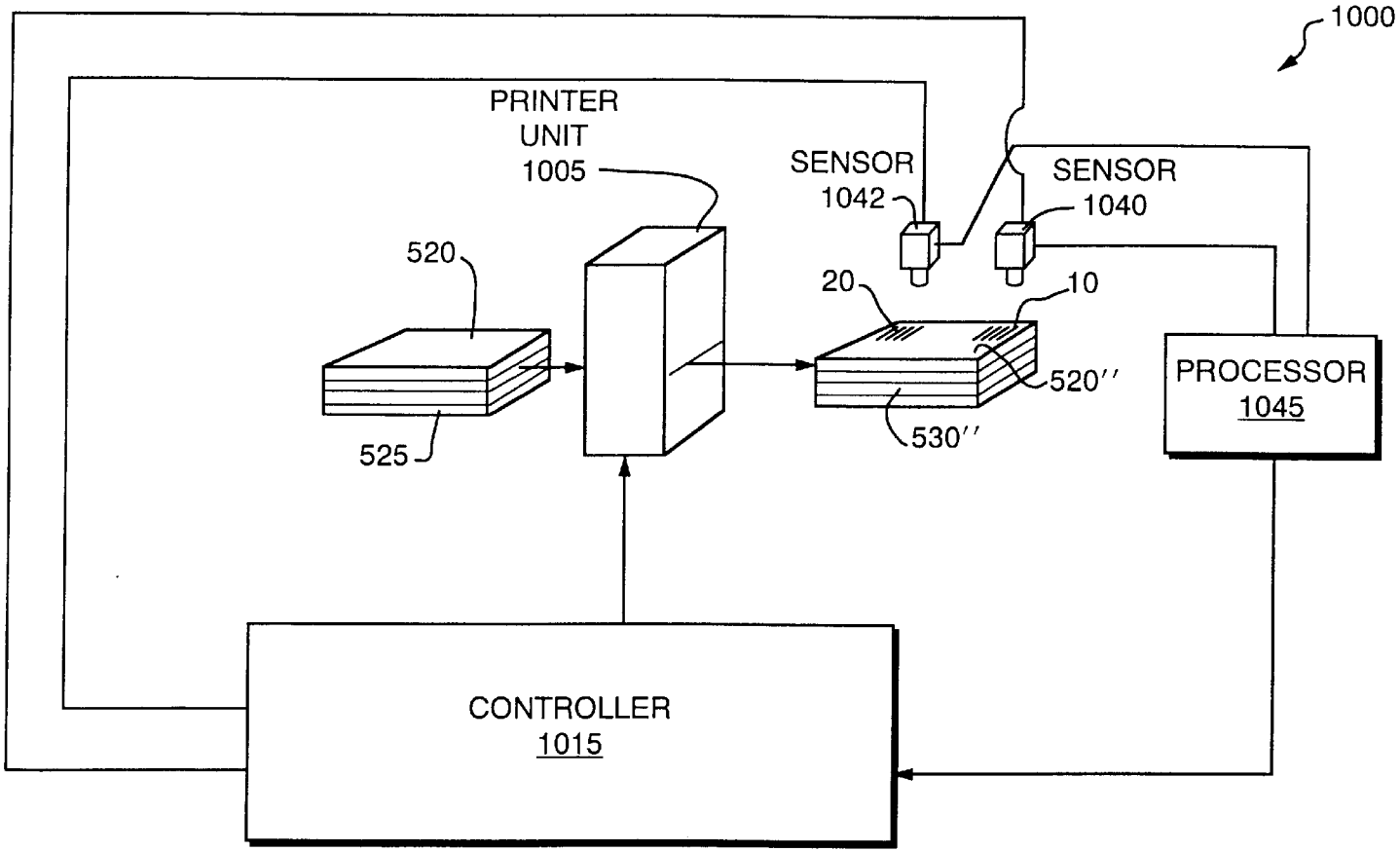
FIG. 10 depicts yet another system for implementing image position error detection in accordance with the present invention.

FIG. 10 depicts yet another system 1000 suitable for implementing the above described technique. The system includes a printer unit 1005 which is substantially similar to the previously described printer units and includes a scan engine 580 and laser 595, as depicted in FIG. 5A or rollers 560, 565 and inking system 570 of FIG. 5B. Individual sheets of media 520 are fed into the printing unit 1005 from the media stack 525. The printer unit 1005 is driven by the controller 1015 to form symbol 10, as detailed in FIG. 1A, in one corner of the sheet 520 and the pattern 20, detailed in FIG. 1B, in another corner of the sheet 520. The sheet 520" with patterns 10 and 20 separately written thereon exit the printing unit 1005 onto the media stack 530".

Respective sensor assemblies 1040 and 1045 read the respective patterns 10 and 20 from the media sheet 520" and respectively transmit digitized signals representing pattern 10 and pattern 20 to the processor 1045. The processor 1045 processes the received signals to form an electronic representation of a registration mark 30 corresponding to the superpositioning of the patterns 10 and 20. The processor 1045 also determines whether or not the symbol 2 embedded in the pattern 10 is exposed in the registration mark 30 or if the density of the registration mark 30 is indicative of a misalignment exceeding a given tolerance. The processor 1045 generates an output signal to the controller 1015 indicating either satisfactory or unsatisfactory repeatability of the printer unit 1005. In the latter case, the controller 1015 either directs the printer unit 1005 to adjust the scan engine 580 or rollers 560, 565 operation or to cease further printing operations. As in other implementations, the controller also controls the operation of the sensor assemblies 1040 and 1045.

As described above, the present invention provides an accurate, high visibility indicator of micro-position errors. The indicator is perceivable with an unaided eye. The indicator is self calibrating and easily used to detect micro-position errors. The indicator is also generally insensitive to process characteristics such as spot size, media gamma and media processing. The present invention facilitates microscopic calibration of misalignment errors at a subpixel level to an absolute scale. Misalignment errors which are otherwise imperceivable with an unaided eye are magnified so as to be easily perceivable without the use of a magnifying lens or other devices.

It will also be recognized by those skilled in the art that, while the invention has been described above in terms of one or more preferred embodiments, it is not limited thereto. Various features and aspects of the above described invention may be used individually or jointly. Further, although the invention has been described in the context of its implementation in a particular environment and for particular purposes those skilled in the art will recognize that its usefulness is not limited thereto and that the present invention can be beneficially utilized in any number of environments and implementations. Accordingly, the claims set forth below should be construed in view of the full breath and spirit of the invention as disclosed herein.

I claim:

1. A method for detecting image position errors, comprising the steps of:

forming a first pattern, configured in a first configuration, having a symbol embedded therein; and forming a second pattern, configured in a second configuration different than the first configuration, the second pattern being configured such that superpositioning the second pattern on the first pattern exposes the symbol if misalignment between said first and said second patterns exceeds a position error tolerance.

2. A method for detecting image position errors, according to claim 1, wherein the first pattern is formed of multiple parallel lines disposed at a pitch, each having a width equal to a number of pixels, and the second pattern is formed of multiple parallel lines disposed at the pitch, each having a width which is equal to the number of pixels plus a position error tolerance.

3. A method for detecting image position errors according to claim 2, wherein:

the second pattern is configured such that the superpositioning of the second pattern over the first pattern superimposes at least one of said multiple lines of said second pattern over a corresponding one of said multiple lines of said first pattern so that said corresponding line has a portion extending beyond an end of the at least one line; and an extent of misalignment between said first and said second patterns within the position error tolerance is detectable by comparing a position of the at least one line with a position of the extending portion of the corresponding line adjacent to the end of the at least one line.

4. A method for detecting image position errors according to claim 2, wherein the pitch is equal to or greater than the number of pixels plus the position error tolerance.

5. A method for detecting image position errors according to claim 1, wherein the forming of the second image and the superpositioning the second image over the first image are performed simultaneously.

6. A system for detecting image position errors, comprising:

a print device configured to form images on media; and a controller operable to drive said print device to form a first pattern configured such that superpositioning of said first pattern on a second pattern exposes a symbol embedded in the second pattern only if misalignment between said first and said second patterns exceeds a position error tolerance greater than zero.

7. A system for detecting image position errors, according to claim 6, wherein the second pattern is formed of multiple parallel lines disposed at a pitch, each having a width equal to a number of pixels, and the controller is further operable to drive the print device to form the first pattern so as to be formed of multiple parallel lines disposed at the pitch, each having a width which is equal to the number of pixels plus a position error tolerance.

8. A system for detecting image position errors according to claim 7, wherein:

the controller is further operable to drive the print device such that the first pattern is configured to have at least one of said multiple lines of said first pattern superimposed over a corresponding one of said multiple lines of said second pattern and said corresponding line has a portion extending beyond an end of the at least one line; and an extent of misalignment between said first and said second patterns within the position error tolerance is detectable by comparing a position of the at least one line with a position of the extending portion of the corresponding line adjacent to the end of the at least one line.

9. A system for detecting image position errors according to claim 6, wherein the at least one controller is further operable to drive the at least one scanner to write the second pattern on a medium and to write the first pattern on the medium superpositioned over the second pattern to thereby expose the symbol embedded in the second pattern if misalignment between said first and said second patterns exceeds the position error tolerance.

10. A system for detecting image position errors according to claim 6, further comprising:

at least one sensor assembly configured to read the first pattern and generate a signal representative thereof, and to read the second pattern and generate a signal representative thereof; and a processor configured to process the signal representing the first pattern and the signal representing the second pattern to determine if superpositioning of the first pattern on the second pattern exposes the symbol.

11. A system for detecting image position errors according to claim 6, wherein the controller is further operable to drive the print device to form the first pattern superpositioned on the second pattern and further comprising:

a sensor assembly configured to read the superpositioned patterns and to generate a signal representative thereof; and a processor configured to process the signal representing the superpositioned patterns to determine if the symbol is exposed.

12. A method for detecting image position errors, comprising the steps of:

forming a first pattern having a symbol embedded therein; and forming a second pattern configured such that superpositioning the second pattern on the first pattern exposes the symbol only if misalignment between said first and said second patterns exceeds a position error tolerance greater than zero.

13. A method for detecting image position errors according to claim 12, wherein the second pattern is configured such that the superpositioning of the second pattern over the first pattern fails to expose the symbol if misalignment of said first and said second patterns is within the position error tolerance.

14. A method for detecting image position errors, according to claim 12, wherein the first pattern is formed of multiple parallel lines disposed at a pitch, each having a width equal to a number of pixels, and the second pattern is formed of multiple parallel lines disposed at the pitch, each having a width which is equal to the number of pixels plus a position error tolerance.

15. A method for detecting image position errors according to claim 14, wherein:

the second pattern is configured such that the superpositioning of the second pattern over the first pattern superimposes at least one of said multiple lines of said second pattern over a corresponding one of said multiple lines of said first pattern so that said corresponding line has a portion extending beyond an end of the at least one line; and an extent of misalignment between said first and said second patterns within the position error tolerance is detectable by comparing a position of the at least one line with a position of the extending portion of the corresponding line adjacent to the end of the at least one line.

16. A method for detecting image position errors according to claim 14, wherein the pitch is equal to or greater than the number of pixels plus the position error tolerance.

17. A method for detecting image position errors according to claim 12, wherein the forming of the second pattern and the superpositioning the second pattern over the first pattern are performed simultaneously.

18. A system for detecting image position errors, comprising:

a print device configured to form images on media; and a controller operable to drive said print device to form a first pattern, configured in a first configuration, the first pattern being configured such that superpositioning of said first pattern on a second pattern, configured in a second configuration different than the first configuration, exposes a symbol embedded in the second pattern if misalignment between said first and said second patterns exceeds a position error tolerance.

19. A system for detecting image position errors, according to claim 18, wherein the second pattern is formed of multiple parallel lines disposed at a pitch, each having a width equal to a number of pixels, and the controller is further operable to drive the print device to form the first pattern of multiple parallel lines disposed at the pitch, each having a width which is equal to the number of pixels plus a position error tolerance.

20. A system for detecting image position errors according to claim 19, wherein:

the controller is further operable to drive the print device such that the first pattern is configured to have at least one of said multiple lines of said first pattern superimposed over a corresponding one of said multiple lines of said second pattern and said corresponding line has a portion extending beyond an end of the at least one line; and an extent of misalignment between said first and said second patterns within the position error tolerance is detectable by comparing a position of the at least one line with a position of the extending portion of the corresponding line adjacent to the end of the at least one line.

21. A system for detecting image position errors according to claim 18, further comprising:

at least one sensor assembly configured to read the first pattern and generate a signal representative thereof, and to read the second pattern and generate a signal representative thereof; and a processor configured to process the signal representing the first pattern and the signal representing the second pattern to determine if superpositioning of the first pattern on the second pattern exposes the symbol.

22. A system for detecting image position errors according to claim 18, wherein the controller is further operable to drive the print device to form the first pattern superpositioned on the second pattern and further comprising:

a sensor assembly configured to read the superpositioned patterns and to generate a signal representative thereof; and a processor configured to process the signal representing the superpositioned patterns to determine if the symbol is exposed.

* * * * *